US009770083B2

(12) United States Patent
Gutierrez

(10) Patent No.: US 9,770,083 B2
(45) Date of Patent: Sep. 26, 2017

(54) SHOE TRAVELER

(71) Applicant: Yvonne DNise Gutierrez, Naples, FL (US)

(72) Inventor: Yvonne DNise Gutierrez, Naples, FL (US)

( * ) Notice: Subject to any disclaimer, the term of this patent is extended or adjusted under 35 U.S.C. 154(b) by 133 days.

(21) Appl. No.: 14/297,623

(22) Filed: Jun. 5, 2014

(65) Prior Publication Data

US 2015/0189964 A1 Jul. 9, 2015

Related U.S. Application Data

(63) Continuation-in-part of application No. 12/944,696, filed on Nov. 11, 2010, now abandoned.

(51) Int. Cl.

| | |
|---|---|
| ***A45C 13/02*** | (2006.01) |
| ***B65D 85/18*** | (2006.01) |
| ***A45C 3/12*** | (2006.01) |
| ***A45C 13/03*** | (2006.01) |
| ***A45C 5/03*** | (2006.01) |

(52) U.S. Cl.

CPC ..... *A45C 13/02* (2013.01); *A45C 3/12* (2013.01); *A45C 5/03* (2013.01); *A45C 13/03* (2013.01); *B65D 85/187* (2013.01); *Y10T 29/49826* (2015.01)

(58) Field of Classification Search

CPC ..... A47F 7/08; A47F 5/0838; A45L 23/16; A43D 3/14; A45C 3/12; A45C 3/00; A47B 61/04; G09F 5/02

See application file for complete search history.

(56) References Cited

U.S. PATENT DOCUMENTS

| | | | | |
|---|---|---|---|---|
| 595,196 | A | 12/1897 | Newman et al. | |
| 602,027 | A | 4/1898 | Booth et al. | |
| 678,356 | A | 7/1901 | Carver | |
| 754,047 | A | 3/1904 | Burt et al. | |
| 789,782 | A | 5/1905 | Yates | |
| 790,669 | A | 5/1905 | Winship | |
| 940,812 | A * | 11/1909 | Hermann | A47F 7/08 211/181.1 |
| 1,057,195 | A | 3/1913 | Wheary | |
| 1,060,497 | A | 4/1913 | Rountree | |
| 1,171,394 | A | 2/1916 | Wheary | |
| 1,231,713 | A | 7/1917 | Cummings | |
| 1,310,281 | A * | 7/1919 | Clark | A47G 25/005 12/116.8 |
| 1,455,964 | A | 5/1923 | Meyer | |
| 1,607,253 | A | 11/1926 | Enright | |
| 1,950,242 | A | 3/1934 | Hollingshead | |
| 1,968,580 | A | 7/1934 | Wheary | |
| 2,587,971 | A | 3/1952 | Crawford | |
| 2,613,816 | A * | 10/1952 | Sbicca | A43D 117/00 211/34 |
| 2,698,689 | A | 1/1955 | Novack | |
| 2,816,628 | A | 12/1957 | Garfield | |

(Continued)

OTHER PUBLICATIONS

Google search "small organizer removable dividers", search date Jan. 17, 2017, with setting for images before Jun. 4, 2014.*

(Continued)

*Primary Examiner* — Tri Mai

(57) ABSTRACT

In one embodiment of the invention, apparatus comprises: a luggage organizer that can be disposed within an opening of a luggage.

8 Claims, 28 Drawing Sheets

(56) References Cited

U.S. PATENT DOCUMENTS 2,943,899 A * 7/1960 Beller ..... A45C 3/12 211/119
2,961,685 A * 11/1960 Aiken ..... A47L 23/18 12/53.6
2,991,495 A * 7/1961 Blalack ..... A47L 23/16 15/265
3,001,650 A 9/1961 Turner
3,381,782 A * 5/1968 Ikelheimer ..... A45C 13/02 190/110
3,539,052 A 11/1970 Bellock
3,563,390 A * 2/1971 Kim ..... A47B 61/04 211/35
3,608,738 A * 9/1971 Andersen ..... A47L 23/20 211/38
3,669,276 A 6/1972 Woods
3,858,693 A 1/1975 Dubenko
3,943,899 A * 3/1976 Matsuoka ..... F02M 23/09 123/585
4,485,928 A * 12/1984 Staashelm ..... A47B 61/04 211/1.3
4,699,267 A 10/1987 Burke
4,982,820 A * 1/1991 Scott ..... A45C 9/00 190/13 R
5,318,174 A * 6/1994 Zoroufy ..... A47F 5/0838 211/105.1
5,505,354 A * 4/1996 Hutton ..... A01K 97/06 206/315.11
6,257,436 B1 * 7/2001 McGlauflin ..... B65D 25/06 206/223
D453,994 S 3/2002 Messner
6,431,418 B1 8/2002 Pease
7,506,757 B1 * 3/2009 Ater ..... A63F 11/0002 206/315.1
2009/0000894 A1 * 1/2009 Middup ..... A45C 5/14 190/15 R
2009/0039747 A1 2/2009 Webster, II et al.
2012/0118838 A1 5/2012 Gutierrez

OTHER PUBLICATIONS

Office Action mailed Jul. 12, 2013 for U.S. Appl. No. 12/944,696.
Office Action mailed Jan. 15, 2013 for U.S. Appl. No. 12/944,696.
Office Action mailed Feb. 5, 2014 for U.S. Appl. No. 12/944,696.

* cited by examiner

SHOE TRAVELER

CROSS-REFERENCE TO RELATED APPLICATIONS

This application is a continuation-in-part of U.S. application Ser. No. 12/944,696, filed 11 Nov. 2010. U.S. application Ser. No. 12/944,696 is hereby fully incorporated herein by reference.

BACKGROUND OF THE INVENTION

1. Related Field

Embodiments of the invention generally relate to luggages.

2. Background Art

It is difficult for traveling persons to pack footwear such as various types of shoes (e.g., men's shoes, women's shoes, children's shoes, athletic shoes, dress shoes, walking shoes, and the like) due to various problems. First, it is difficult to find a luggage space for shoes in a luggage that has been packed with clothing and other travel items. Second, it is difficult to protect the shoes from, for example, being scuffed, being crushed, or deformation (where the shoes lose their shape for wearing), when the shoes are in contact (or rub together) with each other in the packed state. When the shoes rub against each other, the shoes often receive scuffed marks or become deformed. Third, the shoes can cause damage or dirt stains (or water stains) with the neighboring clothes in the packed state, and vice versa. Fourth, by placing the shoes in a luggage, less space is available for clothing and other travel items in the luggage space.

Therefore, the current technology is limited in its capabilities and suffers from at least the above constraints and deficiencies.

SUMMARY

In one embodiment of the invention, an apparatus includes a portable item storage device, a rack that is disposed in the portable item storage device, a first shoe spacer, and a second shoe spacer. Each shoe spacer is removably coupled to the rack and adjustable in size. The portable item storage device is, for example, a luggage.

In another embodiment of the invention, a method of assembling a footwear traveler includes: providing a rack including a horizontal member and vertical members; attaching the vertical members on a sliding member; mounting the sliding member on a base member; attaching brackets on the horizontal member; providing shoe spacers; and attaching an attachment mechanism on the brackets and the shoe spacers, wherein the shoe spacers are removably coupled to the rack by the attachment mechanism.

In yet another embodiment of the invention, an apparatus includes: a rack; and a first shoe spacer and a second shoe spacer, each shoe spacer removably coupled to the rack and adjustable in size.

In yet another embodiment of the invention, an apparatus includes: a rack; first means for providing a shoe spacer; and second means for providing a shoe spacer, each of said first means and second means coupled to the rack and adjustable in size.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION OF PREFERRED EMBODIMENTS

Figure 1:
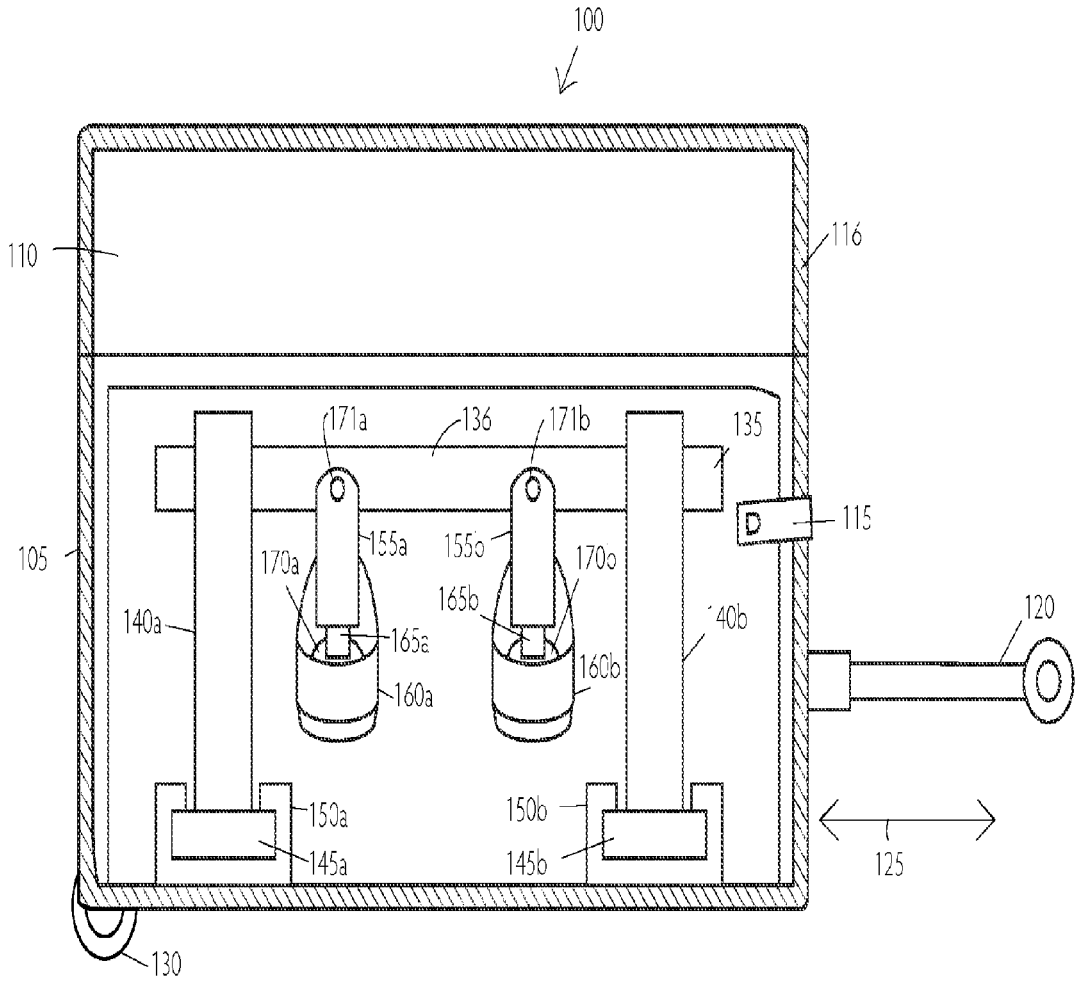
FIG. 1 is a side view of an apparatus in accordance with an embodiment of the invention.

In the description herein, numerous specific details are provided, such as examples of components, parts, structures, and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, structures, and/or the like. In other instances, well-known structures, materials, or operations are not shown or described in detail to avoid obscuring aspects of embodiments of the invention. Additionally, the figures are representative in nature and their shapes are not intended to illustrate the precise shape or precise size of any element and are not intended to limit the scope of the invention.

Those skilled in the art will understand that when an element or part in the drawings is referred to as being "on" (or "coupled" to or "attached" to) another element, it can be directly on (or attached to) the other element or intervening elements may also be present. Furthermore, relative terms such as "inner", "outer", "upper", "above", "lower", "beneath", and "below", and similar terms, may be used herein to describe a relationship of one element or another element. It is understood that these terms are intended to encompass different orientations of the device in addition to the orientation depicted in the figures.

Although the terms first, second, and the like may be used herein to describe various elements, components, regions, layers and/or sections, these elements, components, parts, regions, layers, and/or sections should not be limited by these terms. These terms are only used to distinguish one element, component, part, region, layer, or section from another component, part, region, layer, or section. Thus, a first element, component, part, region, layer, or section discussed below could be termed a second element, component, part region, layer, or section without departing from the teachings of the present invention. Embodiments of the invention are described herein with reference to cross-sectional view illustrations that are schematic illustrations of representative embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing or particular implementations. An element illustrated or described as square or rectangular may typically have rounded or curved features due to normal manufacturing tolerances or due to a particular implementation. Thus, the elements illustrated in the figures are schematic in nature and their shapes are not intended to illustrate the precise shape of an element of a device and are not intended to limit the scope of the invention. FIG. 1 is a side view of an apparatus 100 in accordance with an embodiment of the invention. The apparatus 100 is a shoe traveler (or footwear traveler) that provides various benefits such as, for example, protecting or maintaining the form (e.g., shape), and structure of a shoe in a packed/packaged state, preventing scuff marks on shoes, protecting the shoes from damage, preventing dirt stains (or water stains or other stains) on the shoes, minimizing wear-and-tear on the shoes, preventing damage, dirt stains, water stains and other stains (e.g., color stains) on clothes that were previously packed in the same luggage as the shoes, allowing more space in another luggage packed with clothing because the shoes are instead packed in the shoe traveler, and providing portability and convenience for travelers. The apparatus (shoe traveler or footwear traveler) 100 is useful for anyone who travels for vacations, for business, to family reunions, to local destinations (e.g., from home to the gym, school, rehearsals, photo-events, or other destinations, and vice versa), or for other travels.

In an embodiment of the invention, the shoe traveler (footwear traveler or apparatus) 100 includes a luggage 105 (i.e., portable item storage device 105) for shoes. FIG. 1 shows the luggage 105 with a luggage cover 110 that can close (zip-up) the luggage 105 by use of, for example, a zipper 115 and a zipper track 116. However, other types of suitable mechanisms may be used in place of the zipper 115 (and zipper track 116) to open and close the luggage 105, such as, for example, buttons, Velcro, or other locking mechanisms that can removably secure the luggage cover 110 to the luggage 105.

In an embodiment of the invention, the luggage 105 can include, for example, a handle 120 that can be extended and compressed in the direction 125 and wheels 130 that aid in the portability of the luggage. However, in another embodiment of the invention, the luggage can instead be a duffel bag or other types of suitable portable item storage device. The material for the walls (sides) of the luggage 105 can be any conventional material used for any luggage or similar-function devices.

In an embodiment of the invention, the luggage 105 includes a rack 135 which also includes the horizontal member 136 and vertical members 140*a* and 140*b*. The rack 135 is disposed within or inside the luggage 105. The vertical members 140*a* and 140*b* are on the sliding members 145*a* and 145*b*, respectively. The sliding members 145*a* and 145*b* can slide along the base members 150*a* and 150*b*, respectively, so that the rack 135 can slide into and out of the luggage 105 and the rack 135 is slidable at various positions with respect to the luggage 105, as will be discussed further below.

In an embodiment of the invention, the rack 135 includes the brackets 155*a* and 155*b* that can removably secure or (removably hold) the shoes 160*a* and 160*b*, respectively. The bracket 155*a* is removably coupled by the attachment mechanism 165*a* to a shoe spacer 170*a*. Two components that are removably coupled (or removably attached or removably secured or removably inserted) means that the two different components can be attached together and detached apart. Similarly, the bracket 155*b* is removably coupled by the attachment mechanism 165*b* to a shoe spacer 170*b*. Different types of suitable attachment mechanisms 165*a*/165*b* will be discussed below.

The brackets 155*a* and 155*b* are coupled to the horizontal member 136 (of rack 135) by attachment mechanisms 171*a* and 171*b*, respectively. The attachment mechanisms 171*a*/171*b* are, for example, bolts, screws, glue, or other suitable attachment mechanisms or attachment methods. In another embodiment, the brackets 155*a*/155*b* are integrated into the rack 135, so that the rack 135 and brackets 155*a*/155*b* are a single integrated part. This integrated rack-brackets part can be formed by, for example, molding or other manufacturing methods that are known to those skilled in the art.

The shoe spacer 170*a* is first removed from the bracket 155*a* by detaching the attachment mechanism 165*a* apart as will be discussed further below. The detached shoe spacer 170*a* is then inserted into the shoe piece 160*a* so that the shoe spacer 170*a* is removably secured or removably securable to the shoe piece 160*a*. The shoe spacer 170*a* is then re-attached to the bracket 155*a* by re-attaching the attachment mechanism 165*a* together as will be discussed further below. As a result, the shoe spacer 170*a* is holding the shoe piece 160*a*, and the rack 135 holds the shoe piece 160*a* in place (in a static position or non-moving position) since the shoe piece 160*a* is attached to the rack 135 along the bracket 155*a*, attachment mechanism 165*a*, and the shoe spacer 170*a*.

Similarly, the shoe spacer 170*b* is removably secured or removably securable to the shoe piece 160*b*. The shoe spacer 170*b* is holding the shoe piece 160*b*, and the rack 135 holds the shoe piece 160*b* in place (in a static position or non-moving position) since the shoe piece 160*b* is attached to the rack 135 along the bracket 155*b*, attachment mechanism 165*b*, and the shoe spacer 170*b*. Since the shoes 160*a*/160*b* are held in place in the shoe traveler 100, the above-discussed advantages and benefits (e.g., preventing damage, scuffing, and deformation of the shoes, and protection of shoes and optimized packing of items for the travelling individual) are achieved.

The rack 135 (including the horizontal member 136 and vertical members 140*a*/140*b*), brackets 155*a*/155*b*, slidable members 145*a*/145*b*, and base members 150*a*/150*b* can be constructed, assembled, and/or manufactured from any suitable conventional materials as known to those skilled in the art. For example, the rack 135, brackets 155*a*/155*b* and/or members 145*a*/145*b* and 150*a*/150*b* can be constructed from wood, durable plastic, metal, metal alloys, or combinations of these and other materials. As a specific example, the rack 135 is constructed from wood, metal, metal alloys, or durable plastic, and the brackets 155*a*/155*b* and/or members 145*a*/145*b* and 150*a*/150*b* are constructed from metal, metal alloys, or durable plastic. Those skilled in the art will realize that other suitable materials or combination of suitable materials can be used for the components in the shoe traveler 100.

Figure 2:
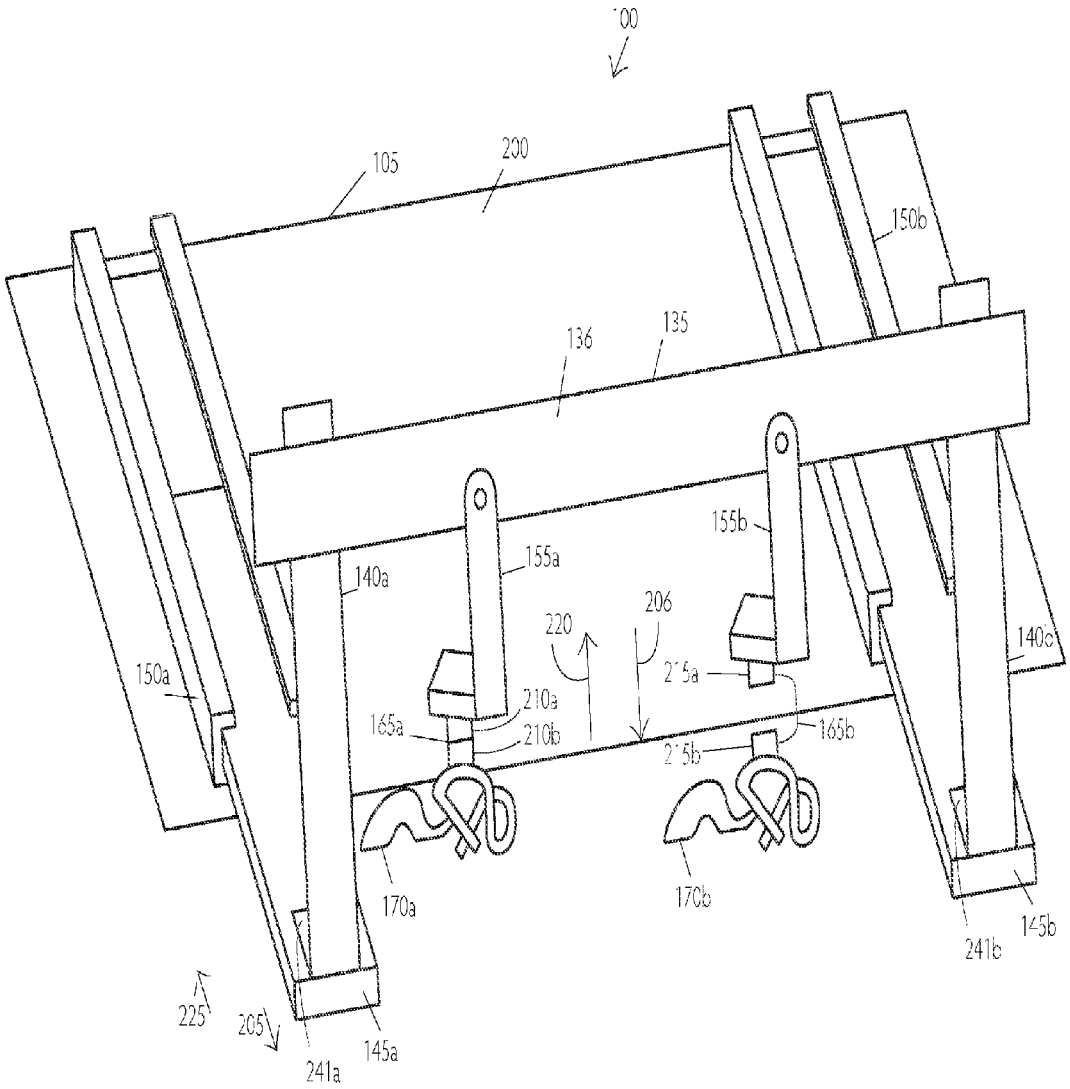
FIG. 2 is a side view of an apparatus in accordance with an embodiment of the invention, where the shoes are not yet secured by the shoe spacers.

FIG. 2 is a side view of an apparatus 100 in accordance with an embodiment of the invention, where the shoe pieces 160*a* and 160*b* (FIG. 1) are not yet respectively secured by the shoe spacers 170*a* and 170*b*, respectively. Generally, the user of apparatus 100 would first unzip (open) the luggage 105, slide out (pull out) the rack 135 from the luggage 105, detach the shoe spacers 170*a* and 170*b* from the respective brackets 155*a* and 155*b*, insert the shoe spacers 170*a* and 170*b* into the shoe pieces 160*a* and 160*b*, respectively, re-attach the shoe spacers 170*a* and 170*b* to the respective brackets 155*a* and 155*b* of the rack 135, slide in (push back) the rack 135 into the luggage 105, and zip-up (close) the luggage 105.

For purposes of clarity, only one side (or wall) 200 of the luggage 105 is shown in FIG. 2. The base members 150*a* and 150*b* are removably coupled to (or permanently coupled to) the side 200 (of luggage 105) by use of any suitable attachment mechanisms such as, for example, glue, Velcro, or other suitable attachment mechanisms or methods. The user of the luggage 105 will unzip (open) the luggage 105 by use of the zipper 115 (FIG. 1). The user then slides out (pulls out) the rack 135, and this movement will cause the sliding members 145*a* and 145*b* to slide away from the base members 150*a* and 150*b*, respectively, in the outward direction 205. The user detaches the shoe spacers 170*a* and 170*b* from the brackets 155*a* and 155*b*, respectively, by detaching (in direction 206) the component 210*b* from component 210*a* (both forming the attachment member 165*a*) and by detaching the component 215*b* from component 215*a* (both forming the attachment member 165*b*). The attachment member 165*b* is shown with the components 215*a* and 215*b* as being detached from each other.

Figure 10:
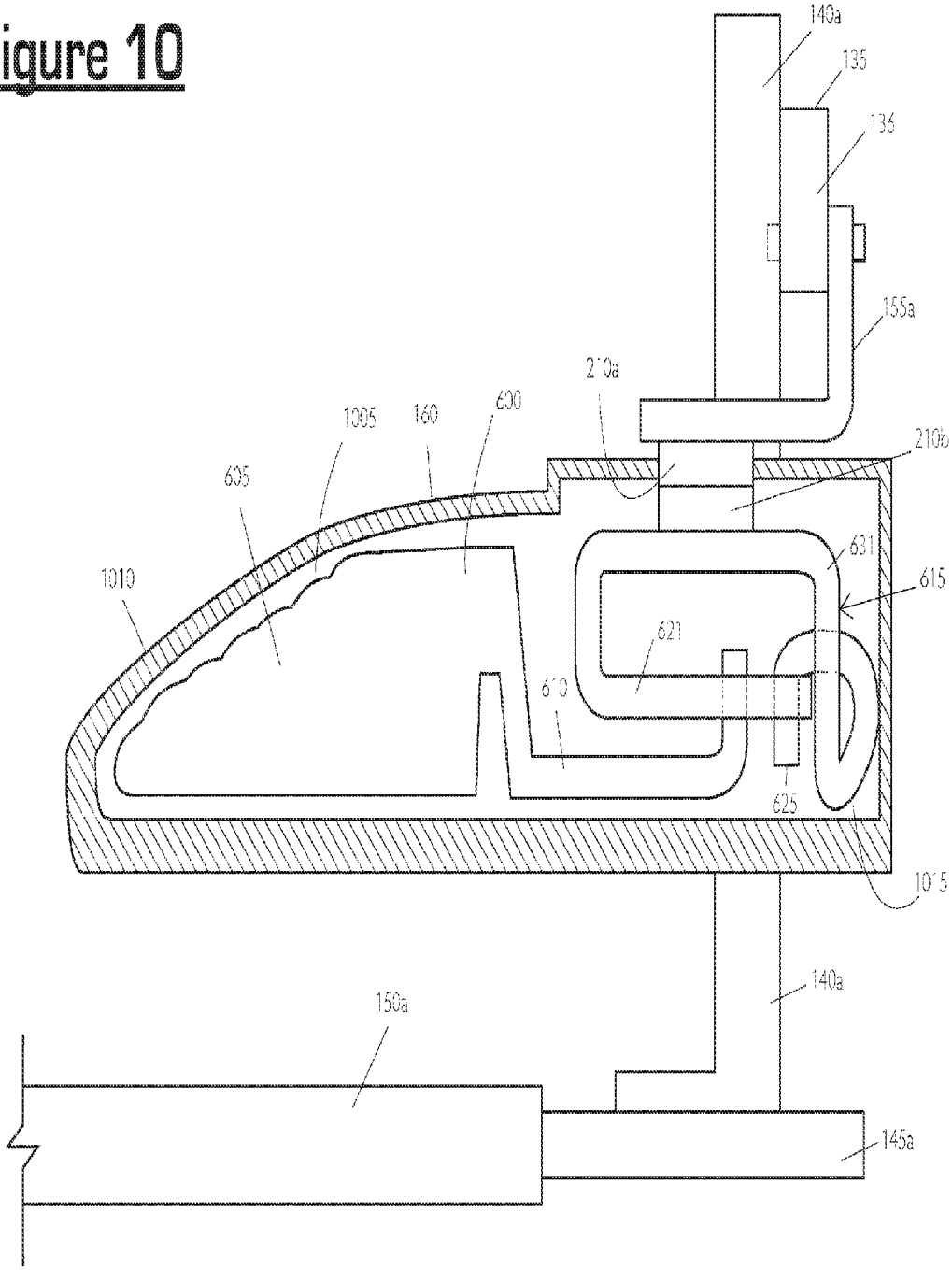
FIG. 10 is a cross-section view of a shoe piece with a shoe spacer that is removably inserted and removably secured in the shoe piece, in accordance with an embodiment of the invention.

The user then inserts the shoe spacers 170*a* and 170*b* into the shoe pieces 160*a* and 160*b*, respectively. As discussed below, FIG. 10 shows an example of a shoe spacer that is removably inserted and removably secured into a shoe.

The user then re-attaches the shoe spacers 170*a* and 170*b* to the brackets 155*a* and 155*b*, respectively, in the direction 220, so that the shoes 160*a*/160*b* are removably secured to the rack 135. The user then slides in (pushes back) the rack 135 into the luggage 105. This sliding in movement will cause the sliding members 145*a* and 145*b* to slide into the base members 150*a* and 150*b*, respectively, in the direction 225. The user can then zip-up (close) the luggage 105, by moving the zipper 115 (FIG. 1) along the zipper track 116 so that the luggage cover 110 will completely close or cover any opening in the luggage 105.

FIG. 2 also shows the vertical member 140*a* (on rack 105) as having a base 241*a* mounted on and attached to the sliding member 145*a* and the vertical member 140*b* as having a base 241*b* mounted on and attached to the sliding member 145*b*, in one embodiment of the invention. In another embodiment of the invention, the vertical member 140*a* is integrated with the sliding member 145*a*, and the vertical member 140*b* is integrated with the sliding member 145*b*. Those skilled in the art will realize, after reading the discussion herein, that the assembly, manufacture, and/or construction of the components of the rack 135 may be selectively varied based on cost, ease of manufacturing, or/and other considerations.

Figure 3:
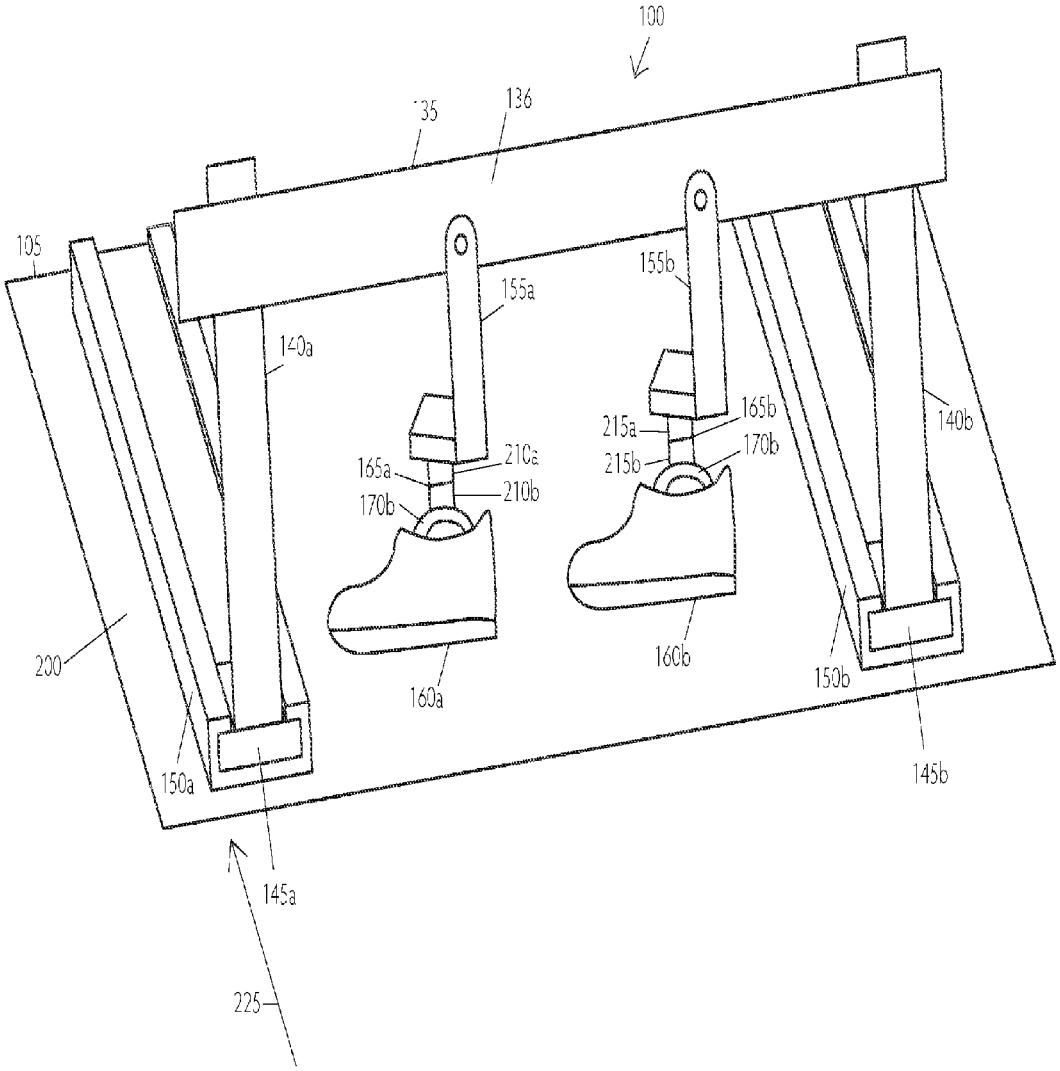
FIG. 3 is a side view of an apparatus in accordance with an embodiment of the invention, where the shoes have been secured by the shoe spacers.

FIG. 3 is a side view of an apparatus 100 in accordance with an embodiment of the invention, where the shoe pieces 160*a* and 160*b* have been secured by the shoe spacers 170*a* and 170*b*, respectively. The user first attaches the shoe pieces 160*a* and 160*b* to the shoe spacers 170*a* and 170*b*, respectively, which are still detached from the brackets 155*a* and 155*b*, respectively. The user then attaches the shoe spacers 170*a* and 170*b* to the brackets 155*a* and 155*b*, respectively. Specifically, the user attaches the component 210*b* (on the shoe spacer 170*a*) to the component 210*a* on the bracket 155*a*, and attaches the component 215*b* (on the shoe spacer 170*b*) to the component 215*a* on the bracket 155*b*.

The user then slides in (pushes in) the rack 135 into the luggage 105, and this movement will cause the sliding members 145*a* and 145*b* to slide into the base members 150*a* and 150*b*, respectively, in the inward direction 225. The user will zip (close) the luggage 105 by use of the zipper 115 (FIG. 1).

Figure 4:
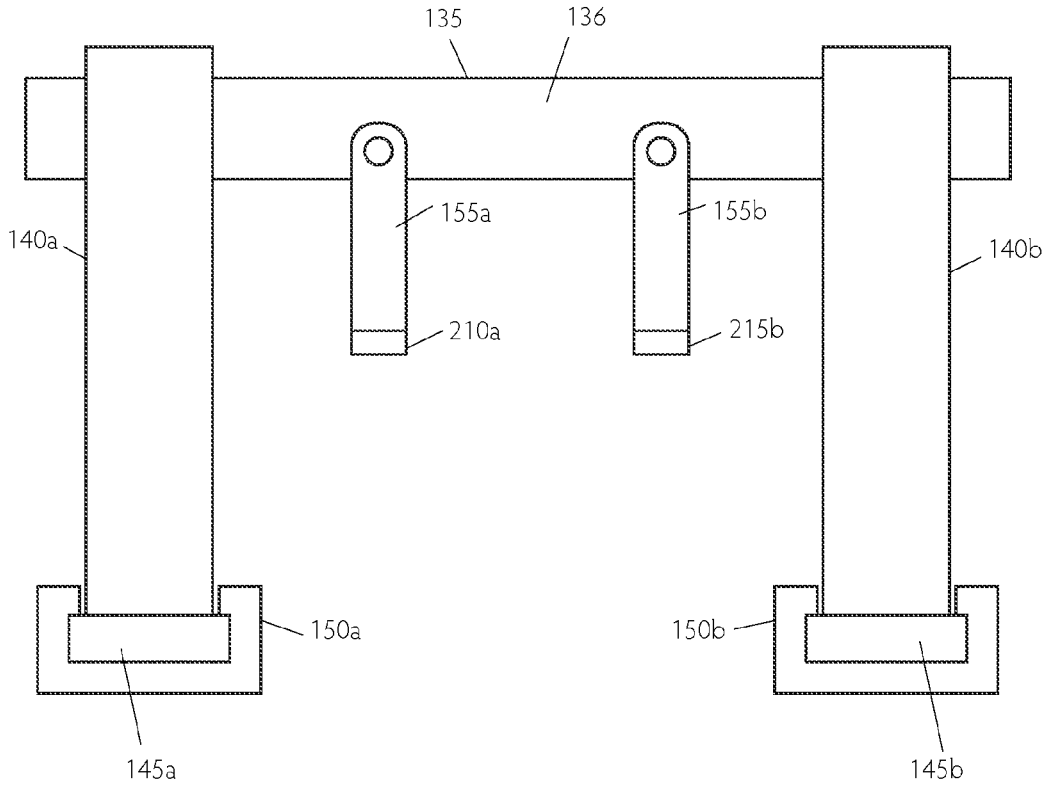
FIG. 4 is a side view of a rack in accordance with an embodiment of the invention.

FIG. 4 is a side view of a rack 135 in accordance with an embodiment of the invention. In this example view, the shoe spacers 170*a* and 170*b* are not coupled to the brackets 155*a* and 155*b*. Additionally, the rack 135 is shown as detached from the luggage 105.

Figure 5:
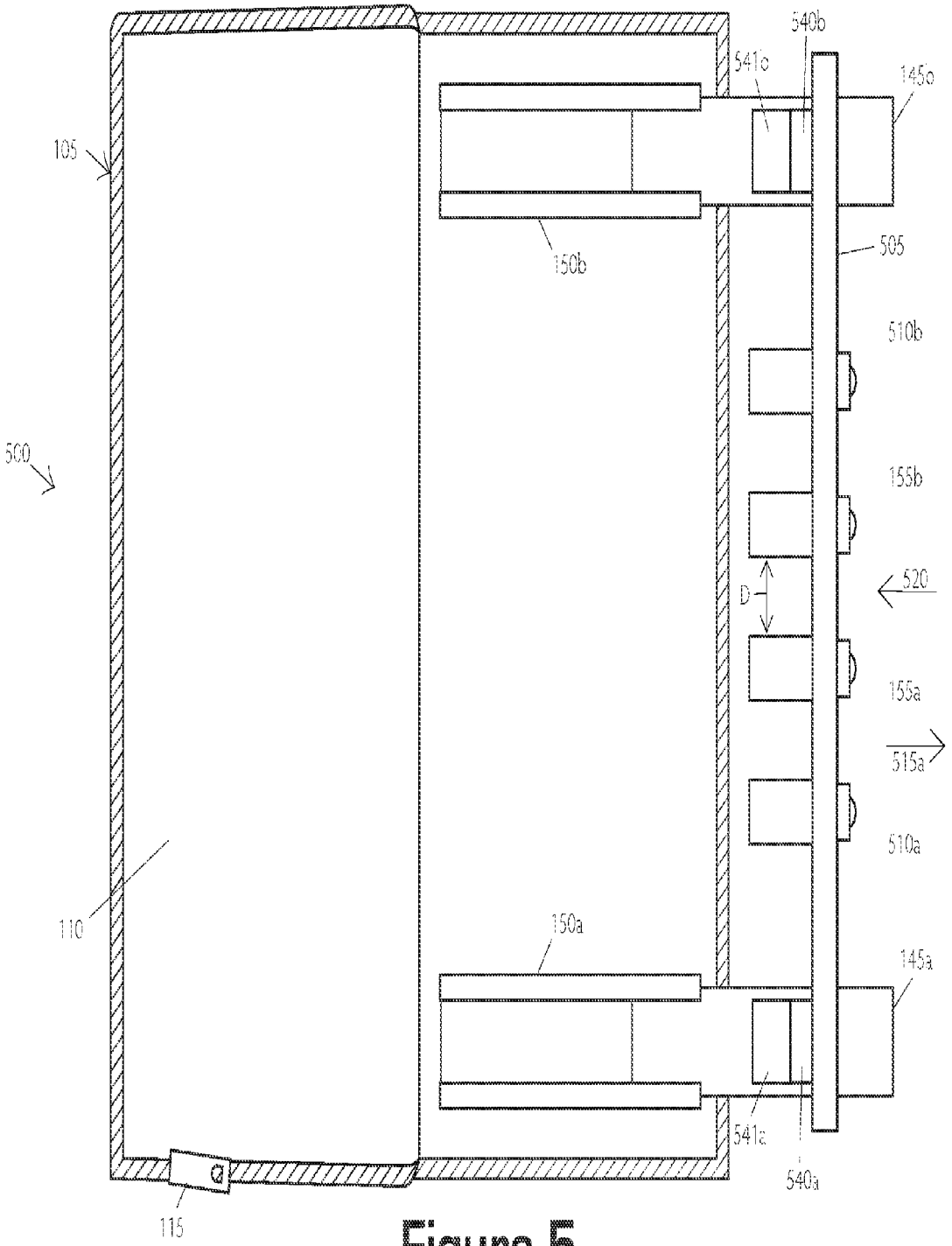
FIG. 5 is a top view of an apparatus in accordance with another embodiment of the invention.

FIG. 5 is a top view of an apparatus 500 in accordance with another embodiment of the invention. The rack 505 includes more than two (2) brackets, as shown by the first and second brackets 155*a*/155*b* and additional third and fourth brackets 510*a*/510*b* that are coupled to the rack 505. Therefore, four (4) shoe pieces (or 2 pairs of shoes) can be removably coupled to the rack 505. The number of brackets coupled to the rack 505 may vary. In an embodiment of the invention, the brackets are separated from each other by a distance D so that the shoe pieces 160*a*/160*b* (FIG. 1) are not in contact with each other when the shoes are attached to adjacent brackets. As a non-limiting example, adjacent brackets are separated by a distance D of at least approximately 4.5 inches.

As in the rack 135 of FIG. 1, the rack 505 can slide away from the luggage 105 in the direction 515 and slide into the luggage 105 in the direction 520. The rack 505 also has the vertical members 540*a* and 540*b* that are attached by the base 541*a* and 541*b* to the sliding members 145*a* and 145*b*, respectively.

Figure 6:
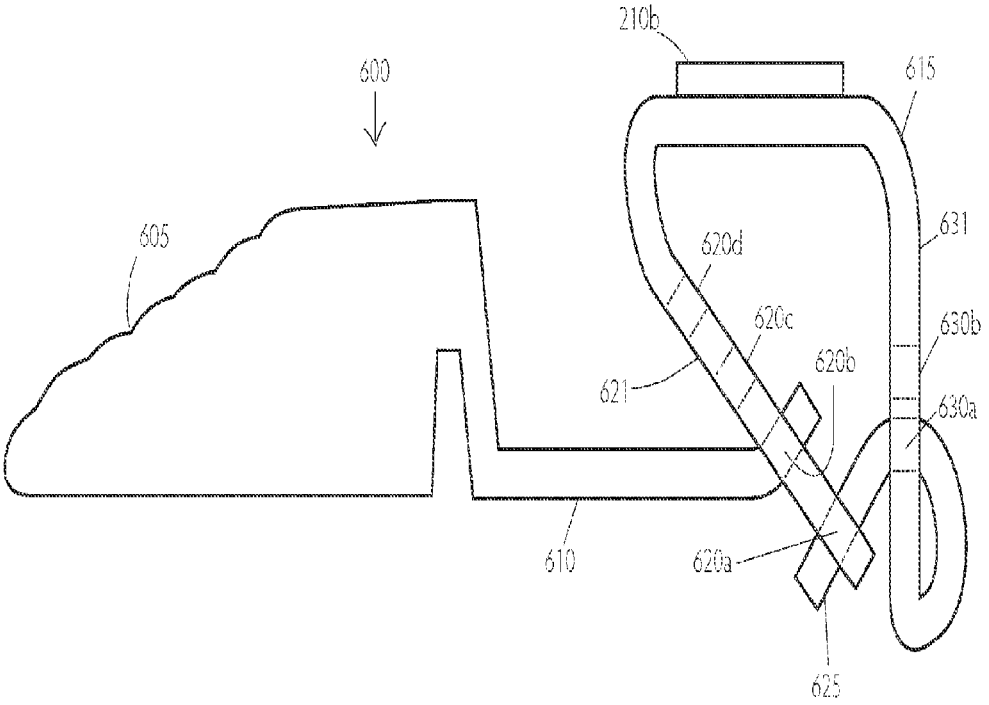
FIG. 6 is a side view of a shoe spacer in accordance with an embodiment of the invention.

FIG. 6 is a side view of a shoe spacer 600 in accordance with an embodiment of the invention. This shoe spacer 600 can be attached to the racks discussed herein (e.g., racks 135 and 505). The shoe spacer 600 includes a front member 605 which is typically shaped similar to a shoe front portion. A rear member 610 is coupled to an adjustable member 615. The attachment component 210*b* (as similarly discussed above) is coupled to the adjustable member 615. It is noted that the shape and configuration of the shoe spacer 600 may be suitably varied so that the shoe spacer 600 can still be removably secured into an opening of a shoe.

To set the shoe spacer 600 at a first given size, the rear member 610 is removably attached to an aperture (opening) 620*b* along a left portion 621, while the end portion 625 is removably attached to the aperture 620*a* along the left portion 621 and to the aperture 630*a* on the right portion 631. It is noted that the left portion 621 can include other apertures such as the aperture 620*c* and 620*d* and the right portion 631 can include other apertures such as the aperture 630*b*, so that the size of the shoe spacer 600 is adjustable to fit different size shoes such as, for example, different sizes of adult shoes and various sizes of children shoes.

Figure 7:
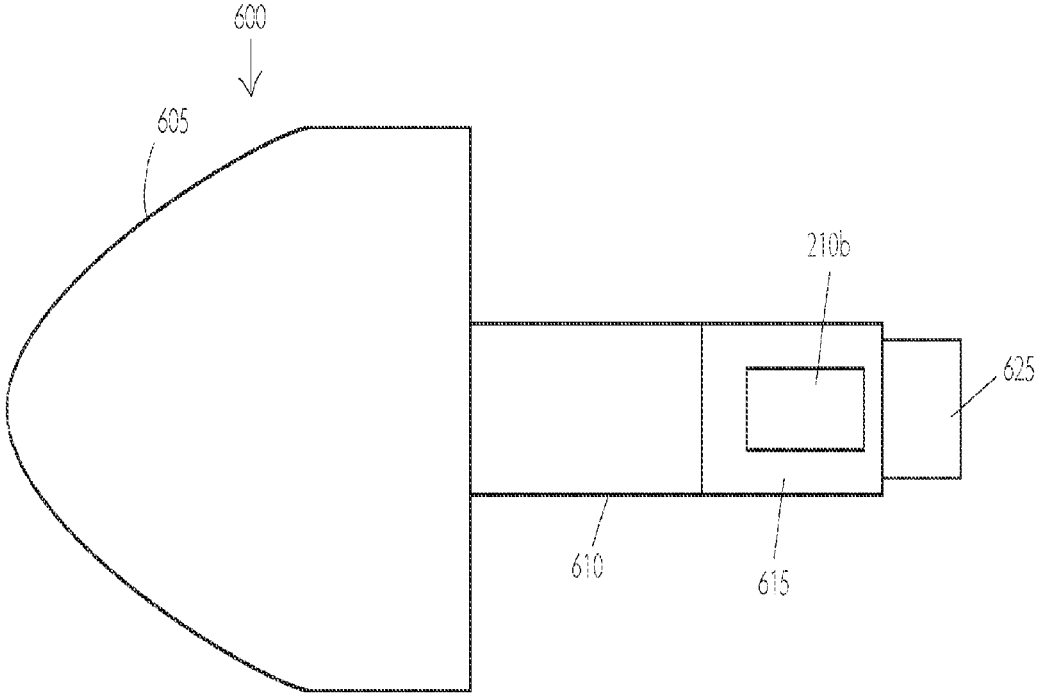
FIG. 7 is a top view of the shoe spacer of FIG. 6, in accordance with an embodiment of the invention.

FIG. 7 is a top view of the shoe spacer 600 of FIG. 6, in accordance with an embodiment of the invention.

Figure 8:
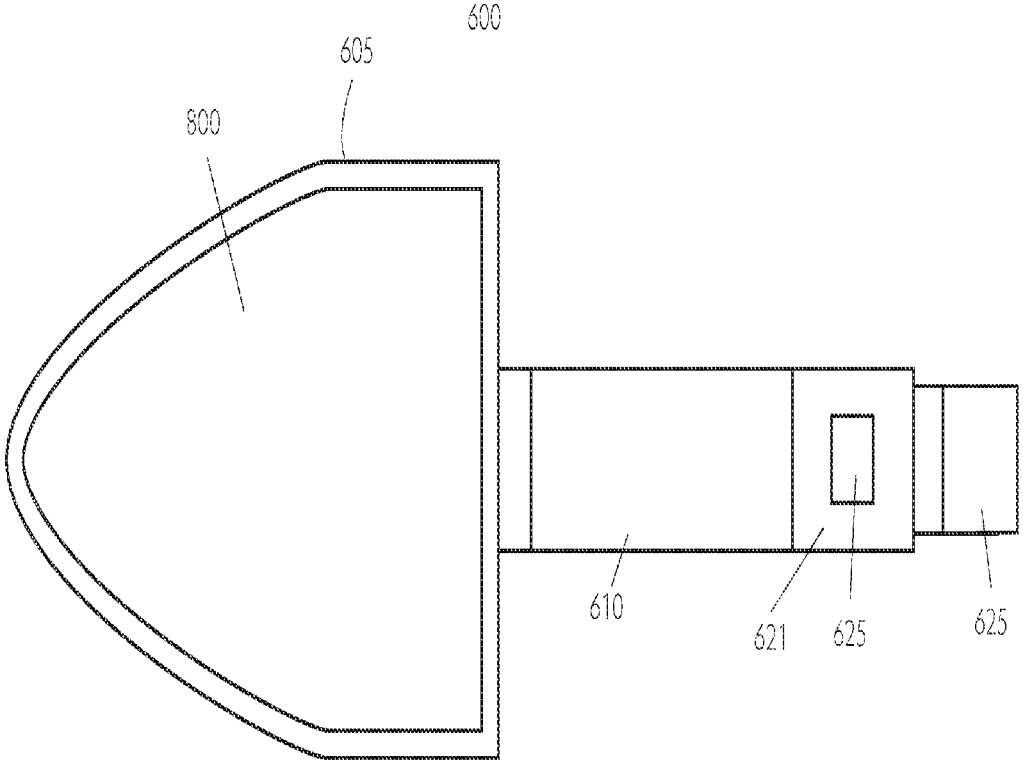
FIG. 8 is a bottom view of the shoe spacer of FIG. 6, in accordance with an embodiment of the invention.

FIG. 8 is a bottom view of the shoe spacer 600 of FIG. 6, in accordance with an embodiment of the invention. The front member 605 can include a domed or hollow section 800 for purposes of saving material or reducing weight of the shoe spacer 600.

Figure 9:
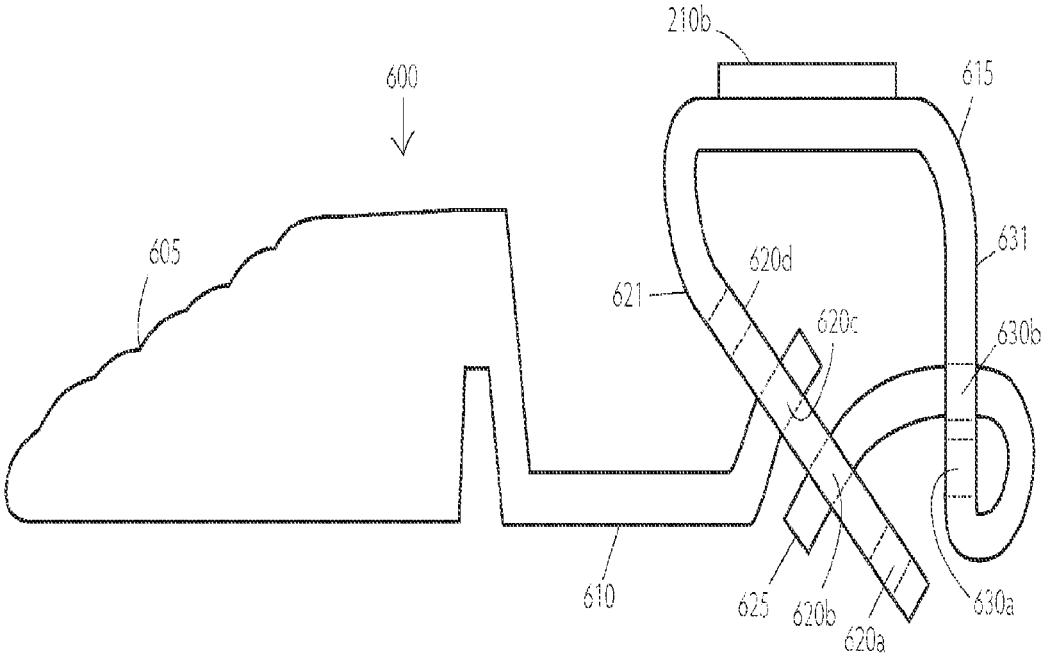
FIG. 9 is a side view of the shoe spacer of FIG. 6 in accordance with an embodiment of the invention, where the size of the shoe spacer has been adjusted.

FIG. 9 is a side view of the shoe spacer 600 of FIG. 6 in accordance with an embodiment of the invention, where the size of the shoe spacer 600 has been adjusted. The size of the shoe spacer 600 is adjusted in FIG. 9 by removably attaching the rear member 610 to the aperture 620*c* and removably attaching the end portion 625 into the aperture 620*b* in the left portion 621 and the aperture 630*b* in the right portion 631. Therefore, the apertures in the left portion 621 and the right portion 631 are used for purposes of varying or adjusting the size of the shoe spacer 600 to fit into different sizes of shoes. It is noted that other types of adjustment mechanisms may be used to vary the size of the shoe spacer 600.

FIG. 10 is a cross-section view of a shoe piece 160 with a shoe spacer 600 that is removably inserted and removably secured in the shoe piece 160, in accordance with an embodiment of the invention. The shoe spacer 600 is inserted into the shoe piece 160 so that the shoe spacer 600 is removably secured in the inside portion 1005 of the shoe piece 160. The front member 605 is secured in the front portion 1010 of the shoe piece 160 and the adjustable member 615 is secured in the rear portion 1015 of the shoe piece 160. The attachment component 210*b* (of the shoe spacer 600) is removably coupled to the attachment component 210*a* (of the bracket 155*a* that is coupled to the rack 135). Therefore, the shoe piece 160 is secured to the rack 135 in a static position.

Figure 11:
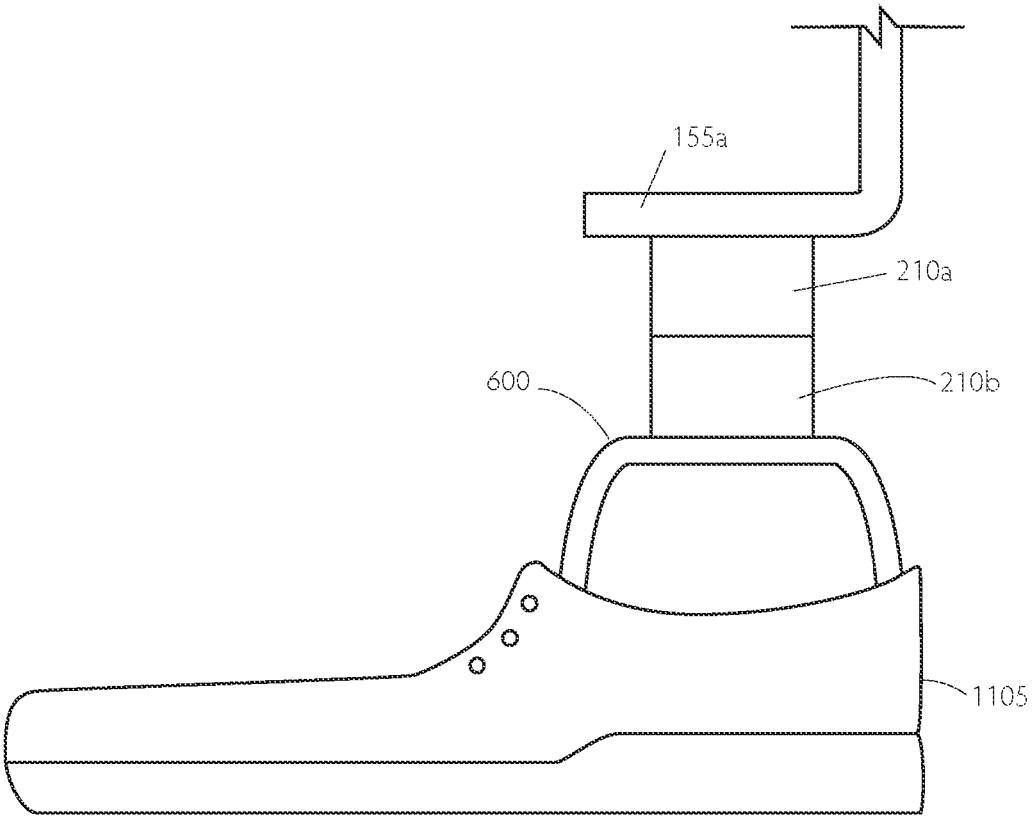
FIG. 11 is a side view of a men-shoe type that is removably secured to a shoe spacer and bracket in a rack, in accordance with an embodiment of the invention.

FIG. 11 is a side view of a men-shoe type 1105 that is removably secured to a shoe spacer 600 and bracket 155*a* in a rack (e.g., rack 135 in FIG. 1), in accordance with an embodiment of the invention. The shoe type 1105 can be any shoes for men such as, for example, walking shoes, dress shoes, boots, or other types of footwear. The shoes can be made of conventional materials such as, for example, leather, vinyl, acrylic, suede, or other types of materials. The shoe spacer 600 is adjustable in size to removably secure the shoe type 1105. As discussed above, the shape of the shoe spacer 600 is flexible, variable, and adjustable, in order to removably insert and removably secure the shoe spacer 600 into a shoe piece. FIG. 11 shows a non-limiting example of the shape of the shoe spacer 600 that is inserted into a shoe piece. It is understood by those skilled in the art that the shape of the shoe spacer 600 may vary depending on the size and/or type of shoe piece that removably receives the shoe spacer 600.

Figure 12:
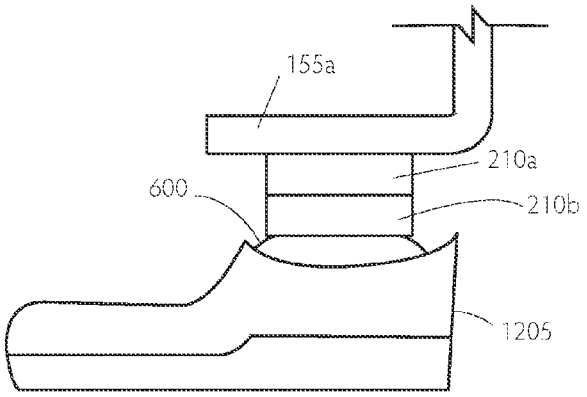
FIG. 12 is a side view of a children-shoe type that is removably secured to a shoe spacer and bracket in a rack, in accordance with an embodiment of the invention.

FIG. 12 is a side view of a children-shoe type 1205 that is removably secured to a shoe spacer 600 and bracket 155*a* in a rack (e.g., rack 135 in FIG. 1), in accordance with an embodiment of the invention. The shoe type 1205 can be any shoes for children such as, for example, walking shoes, dress shoes, boots, or other types of footwear. The shoes can be made of conventional materials such as, for example, leather, vinyl, acrylic, suede, or other types of materials. The shoe spacer 600 is adjustable in size to removably secure the shoe type 1205 which is smaller in size than the adult-sized shoe type 1105 of FIG. 12.

Figure 13:
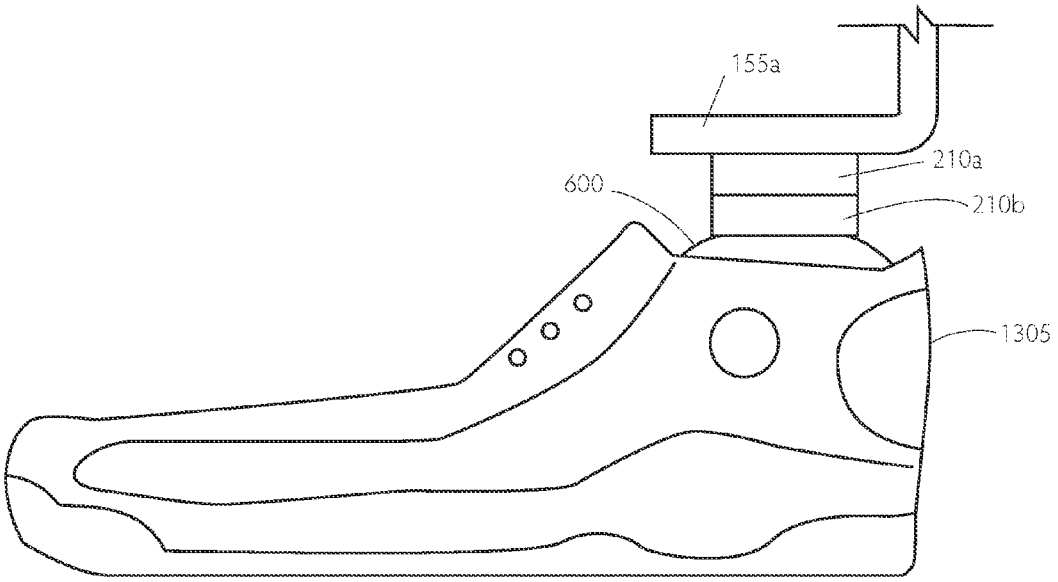
FIG. 13 is a side view of an athletic-shoe type that is removably secured to a shoe spacer and bracket in a rack, in accordance with an embodiment of the invention.

FIG. 13 is a side view of an athletic-shoe type 1305 that is removably secured to a shoe spacer 600 and bracket 155*a* in a rack (e.g., rack 135 in FIG. 1), in accordance with an embodiment of the invention. The shoe type 1305 can be any type of athletic shoes such as, for example, low-top (or mid-top or high-top) basketball shoes, running shoes, cross-trainers, walking shoes, baseball shoes, hockey footwear, or other types of athletic footwear. The shoes can be made of conventional materials such as, for example, leather, vinyl, acrylic, suede, or other types of materials. The shoe spacer 600 is adjustable in size to removably secure the shoe type 1305.

Figure 14:
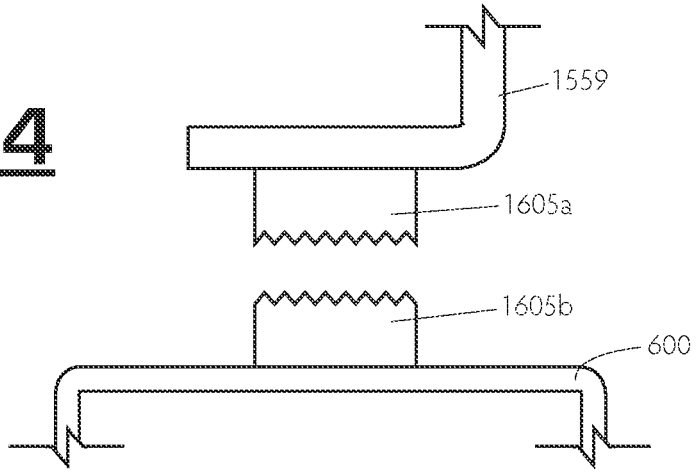
FIG. 14 is a side view of an attachment mechanism for removably coupling the shoe spacer with the rack, in accordance with an embodiment of the invention.

FIG. 14 is a side view of an attachment mechanism 1605*a*/1605*b* for removably coupling the shoe spacer 600 with the rack (e.g., rack 135), in accordance with an embodiment of the invention. Specifically, the attachment mechanism component 1605*a* is coupled to a bracket (e.g., bracket 155*a*) of the rack and the attachment mechanism component 1605*b* is coupled to the shoe spacer 600. The component 1605*a* and component 1605*b* are, for example, Velcro parts that can be removably attached to each other.

Figure 15:
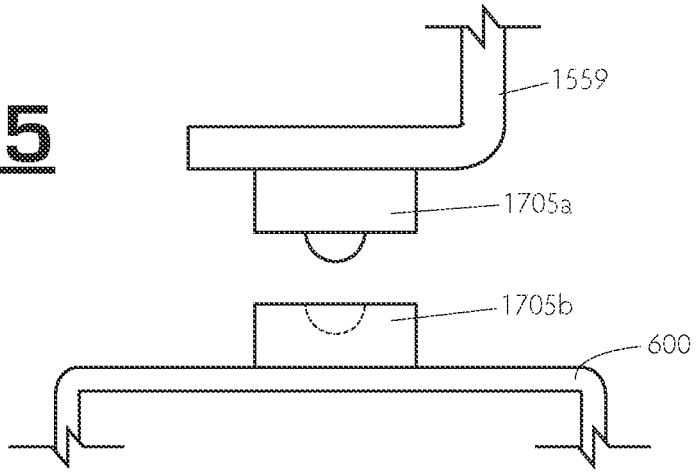
FIG. 15 is a side view of an attachment mechanism for removably coupling the shoe spacer with the rack, in accordance with another embodiment of the invention.

FIG. 15 is a side view of an attachment mechanism 1705*a*/1705*b* for removably coupling the shoe spacer 600 with the rack (e.g., rack 135), in accordance with another embodiment of the invention. Specifically, the attachment mechanism component 1705*a* is coupled to a bracket (e.g., bracket 155*a*) of the rack and the attachment mechanism component 1705*b* is coupled to the shoe spacer 600. The component 1705*a* and component 1705*b* are buttons or a ball-pin lock that can be removably attached to each other, or other suitable snap-on or snap-together locking mechanisms for removably coupling two components together.

Figure 16:
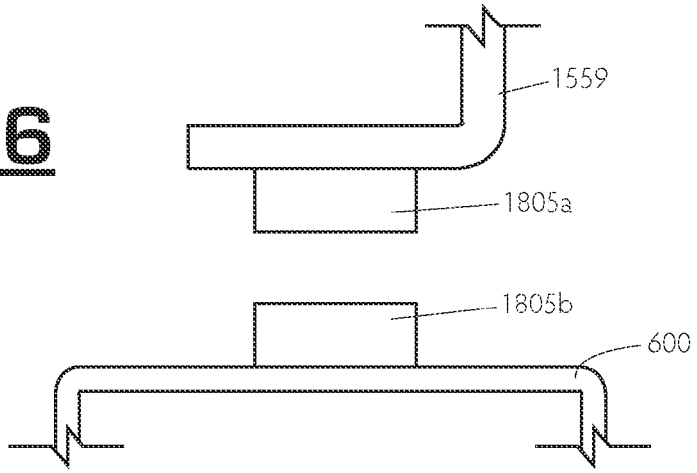
FIG. 16 is a side view of an attachment mechanism for removably coupling the shoe spacer with the rack, in accordance with another embodiment of the invention.

FIG. 16 is a side view of an attachment mechanism 1805*a*/1805*b* for removably coupling the shoe spacer 600 with the rack (e.g., rack 135), in accordance with another embodiment of the invention. Specifically, the attachment mechanism component 1805*a* is coupled to a bracket (e.g., bracket 155*a*) of the rack and the attachment mechanism component 1805*b* is coupled to the shoe spacer 600. The component 1805*a* and component 1805*b* are high strength magnet components or other attachment mechanisms that can be removably attached to each other.

Figure 17:
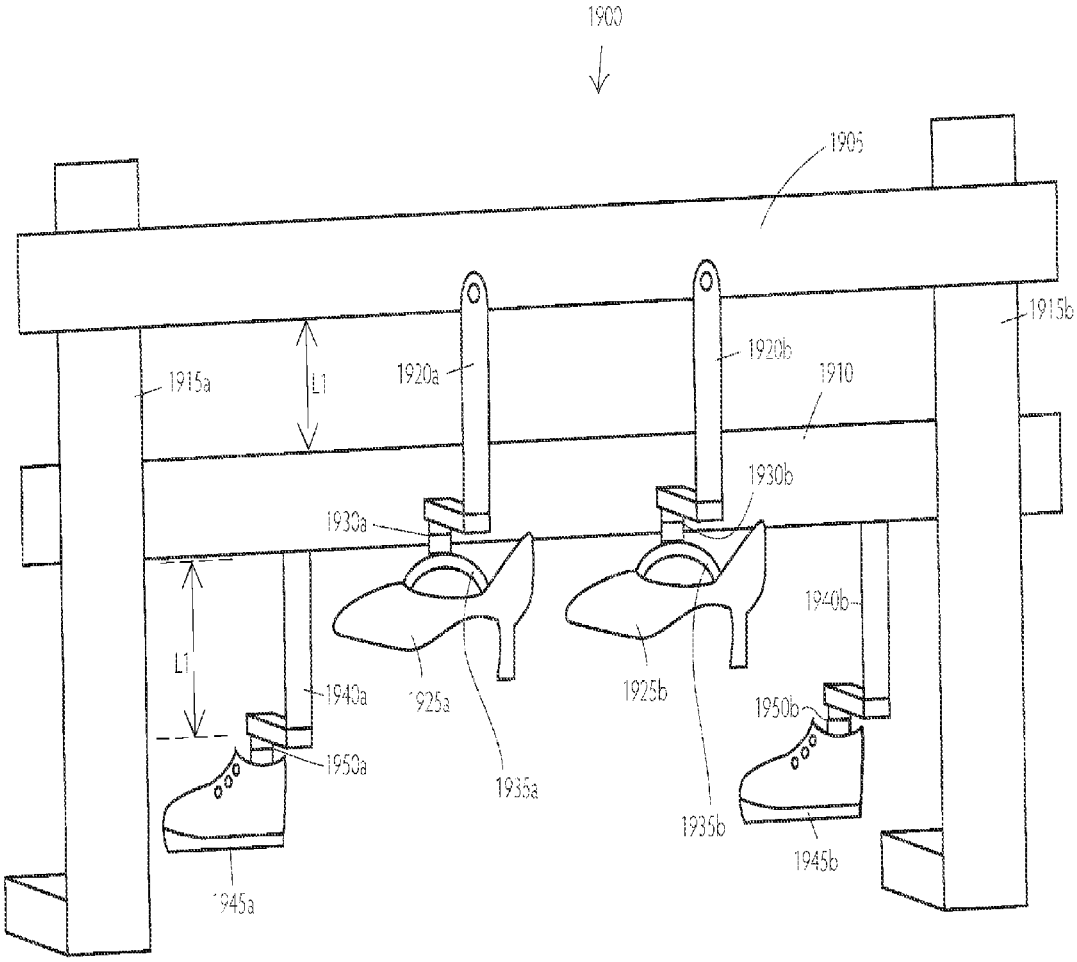
FIG. 17 is a side view of a rack in accordance with another embodiment of the invention.

FIG. 17 is a side view of a rack 1900 in accordance with another embodiment of the invention. The rack 1900 includes a first horizontal member 1905 and a second horizontal member 1910. Both members 1905 and 1910 are coupled to the vertical members 1915*a*/1915*b*.

The brackets 1920*a*/1920*b* are coupled to the first horizontal member 1905. A shoe piece 1925*a* can be attached to a shoe spacer 1935*a* which is removably coupled by attachment mechanism 1930*a* to the bracket 1920*a*. The other shoe piece 1925*b* can be attached to a shoe spacer 1935*b* which is removably coupled by attachment mechanism 1930*b* to the bracket 1920*b*.

The brackets 1940*a*/1940*b* are coupled to the second horizontal member 1910. A shoe piece 1945*a* can be attached to a shoe spacer (not shown in FIG. 19) which is removably coupled by attachment mechanism 1950*a* to the bracket 1940*a*. The other shoe piece 1945*b* can be attached to a shoe spacer (not shown in FIG. 19) which is removably coupled by attachment mechanism 1950*b* to the bracket 1940*b*.

The horizontal members 1905 and 1910 are offset vertically by a distance L1. Consequently, the bottom of the brackets 1940*a*/1940*b* are offset by the same distance L1 from the bottom of the brackets 1920*a*/1920*b*. Therefore, the shoe pair 1925*a*/1925*b* (which can be women shoes with heels) can be placed higher vertically than the shoe pair 1945*a*/1945*b* (which can be men shoes). Therefore, higher heeled shoes can be removably coupled to the higher horizontal member 1905 and still fit within the luggage.

Figure 18A:
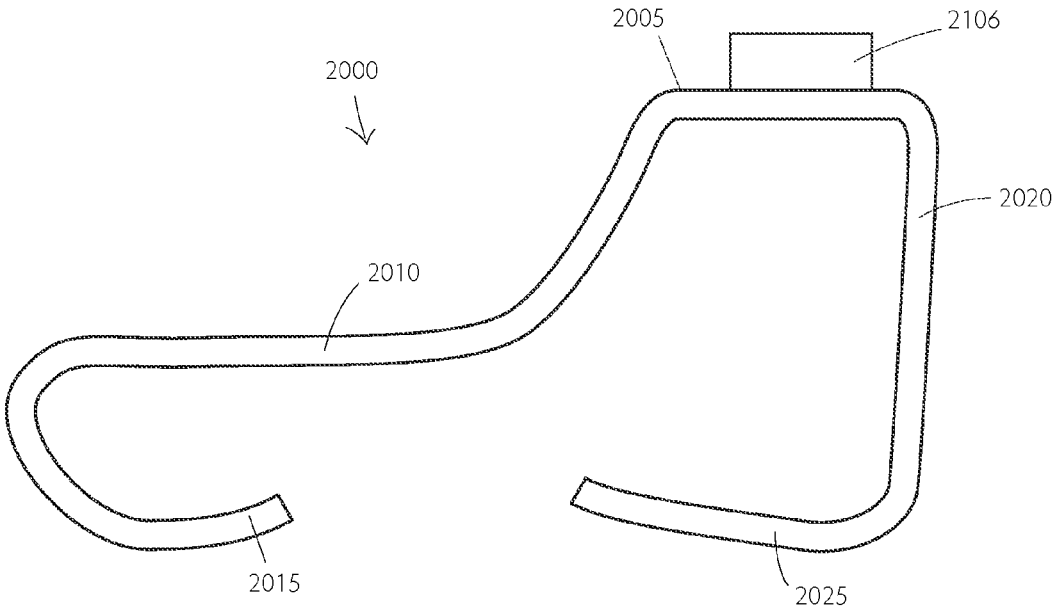
FIG. 18A is a side view of a shoe spacer in accordance with another embodiment of the invention.

FIG. 18A is a side view of a shoe spacer 2000 in accordance with another embodiment of the invention. The shoe spacer 2000 includes a top member 2005, a top front member 2010 which is integrated with the top front member 2005, a bottom front member 2015 which is integrated with the top front member 2010, a rear member 2020 which is integrated with the top member 2005, and bottom rear member 2025 which is integrated with the rear member 2020. An attachment component 210 (which has been discussed above in various embodiments) is mounted or attached on the top member 2005. The members (parts) 2005, 2010, 2015, 2020, and 2025 are flexible and sufficiently firm so that the shoe spacer 2000 is adjustable in size and can be removably inserted into and removably secured with different sizes and different types of shoes. As an example, the parts of the shoe spacer 2000 can be flexible rubber, flexible plastic, flexible synthetic material, or other flexible and sufficiently firm material that can securely hold a shoe piece.

Figure 18B:
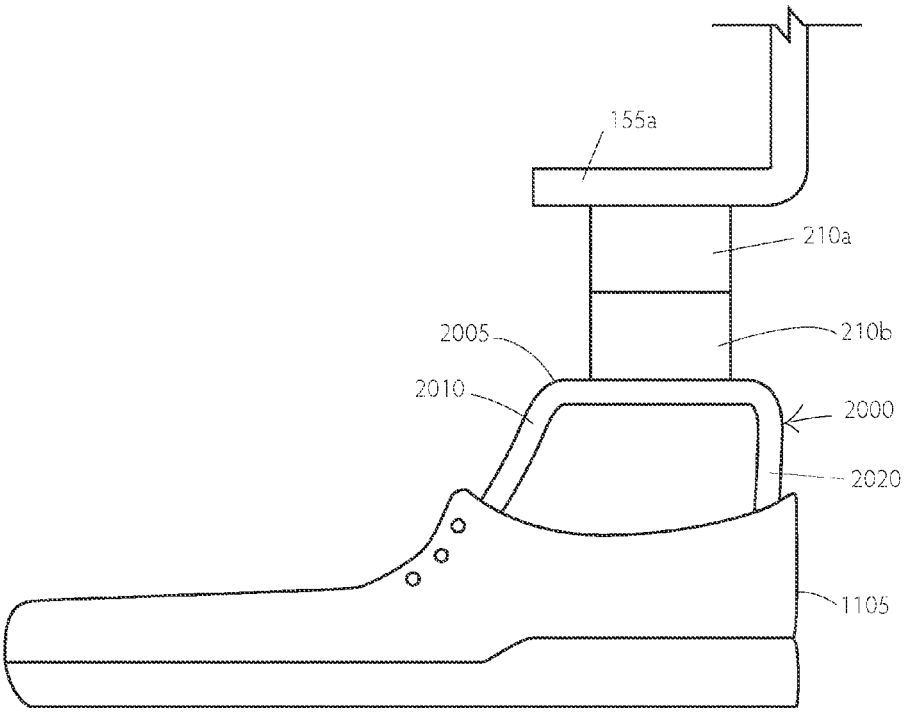
FIG. 18B is a side view of a men-shoe type that is removably secured to a shoe spacer and bracket in a rack, in accordance with another embodiment of the invention.

FIG. 18B is a side view of a men-shoe type 1105 that is removably secured to a shoe spacer 2000 as discussed above and bracket 155*a* in a rack, in accordance with another embodiment of the invention. As discussed above, the shoe type 1105 can be any shoes for men such as, for example, walking shoes, dress shoes, boots, or other types of footwear. The shoe spacer 2000 is adjustable in size to removably secure the shoe type 1105

Figure 18C:
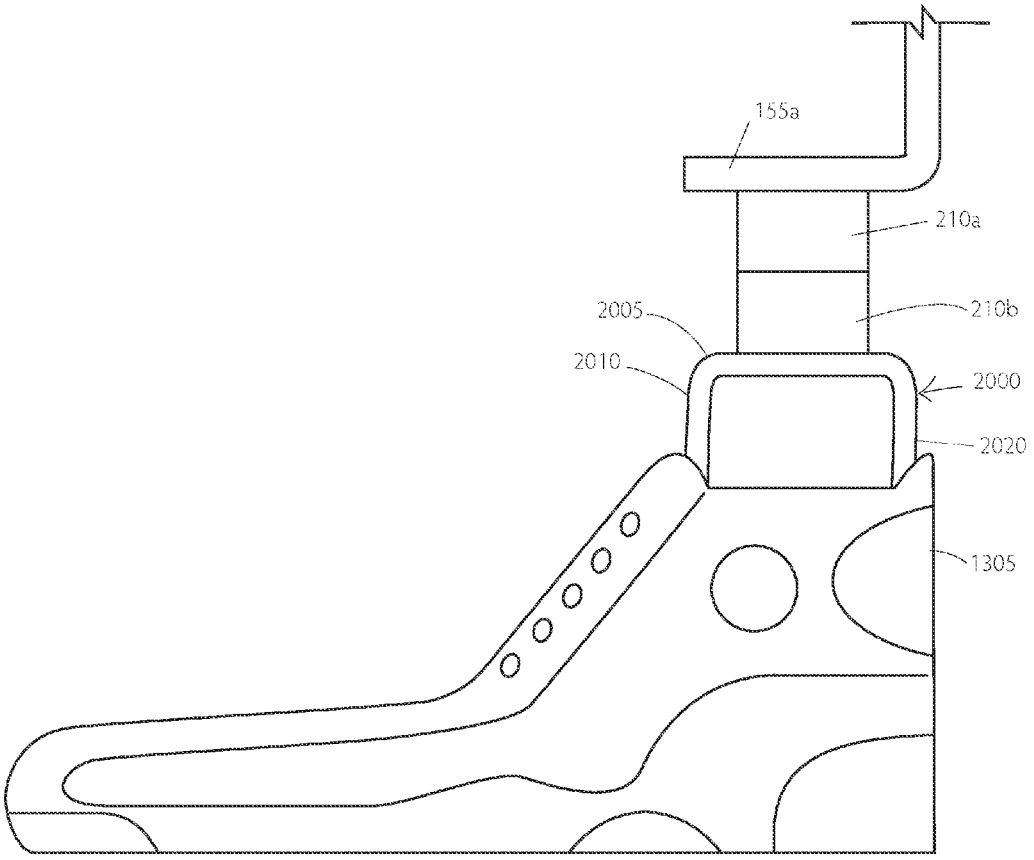
FIG. 18C is a side view of an athletic-shoe type that is removably secured to a shoe spacer and bracket in a rack, in accordance with another embodiment of the invention.

FIG. 18C is a side view of an athletic-shoe type 1305 that is removably secured to a shoe spacer 2000 as discussed above and bracket 155*a* in a rack, in accordance with another embodiment of the invention. As discussed above, the shoe type 1305 can be any type of athletic shoes such as, for example, low-top (or mid-top or high-top) basketball shoes, running shoes, cross-trainers, walking shoes, baseball shoes, hockey footwear, or other types of athletic footwear. The shoe spacer 2000 is adjustable in size to removably secure the shoe type 1305.

Figure 18D:
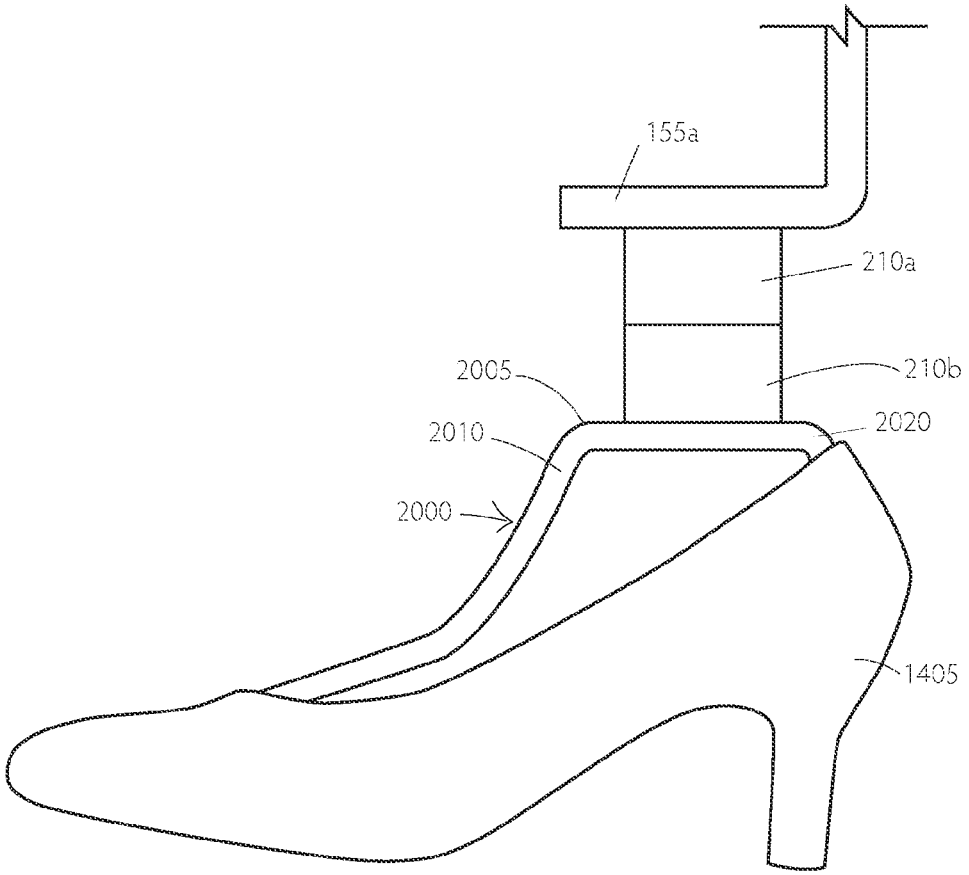
FIG. 18D is a side view of a women-shoe type that is removably secured to a shoe spacer and bracket in a rack, in accordance with another embodiment of the invention.

FIG. 18D is a side view of a women-shoe type 1405 that is removably secured to a shoe spacer 2000 as discussed above and bracket 155*a* in a rack, in accordance with another embodiment of the invention. As discussed above, the shoe type 1405 can be any shoes for women such as, for example, walking shoes, dress shoes, boots, high-heels, evening shoes, or other types of footwear. The shoe spacer 2000 is adjustable in size to removably secure the shoe type 1405. As shown in FIGS. 20A to 20D, the shoe spacer 2000 is adjustable and variable in shape and size, depending on the size or/and type of shoe that is removably secured to the shoe spacer 2000.

Figure 19:
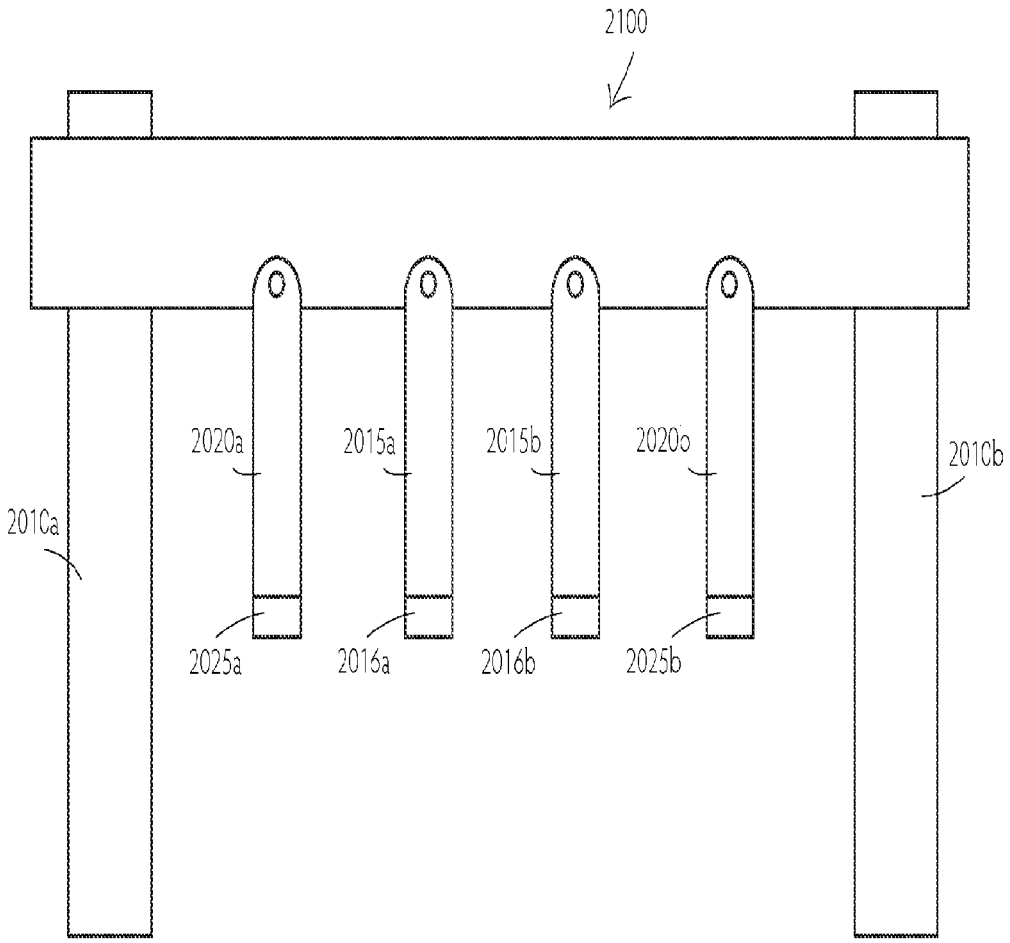
FIG. 19 is a side view of a rack in accordance with another embodiment of the invention.

FIG. 19 is a side view of a rack 2100 in accordance with another embodiment of the invention. The rack 2100 includes the horizontal member 2105 which is attached to the vertical members 2110*a*/2110*b*. The bracket 2115*a* (with attachment component 2116*a*) and bracket 2115*b* (with attachment component 2116*b*) have the same length. The bracket 2120*a* (with attachment component 2125*a*) and bracket 2120*b* (with attachment component 2125*b*) have the same length as the brackets 2120*a* and 2120*b*. The brackets 2115*a*/2115*b* and 2120*a*/2120*b* can be attached to the rack 2100 by attachment mechanisms as previously discussed above or can be integrated with the rack 2100.

In another embodiment of the invention, a method of assembling a footwear traveler includes: providing a rack including a horizontal member and vertical members; attaching the vertical members on a sliding member; mounting the sliding member on a base member; attaching brackets on the horizontal member; providing shoe spacers; and attaching an attachment mechanism on the brackets and the shoe spacers, wherein the shoe spacers are removably coupled to the rack by the attachment mechanism. The various components in the above method have been previously described above.

Figure 20:
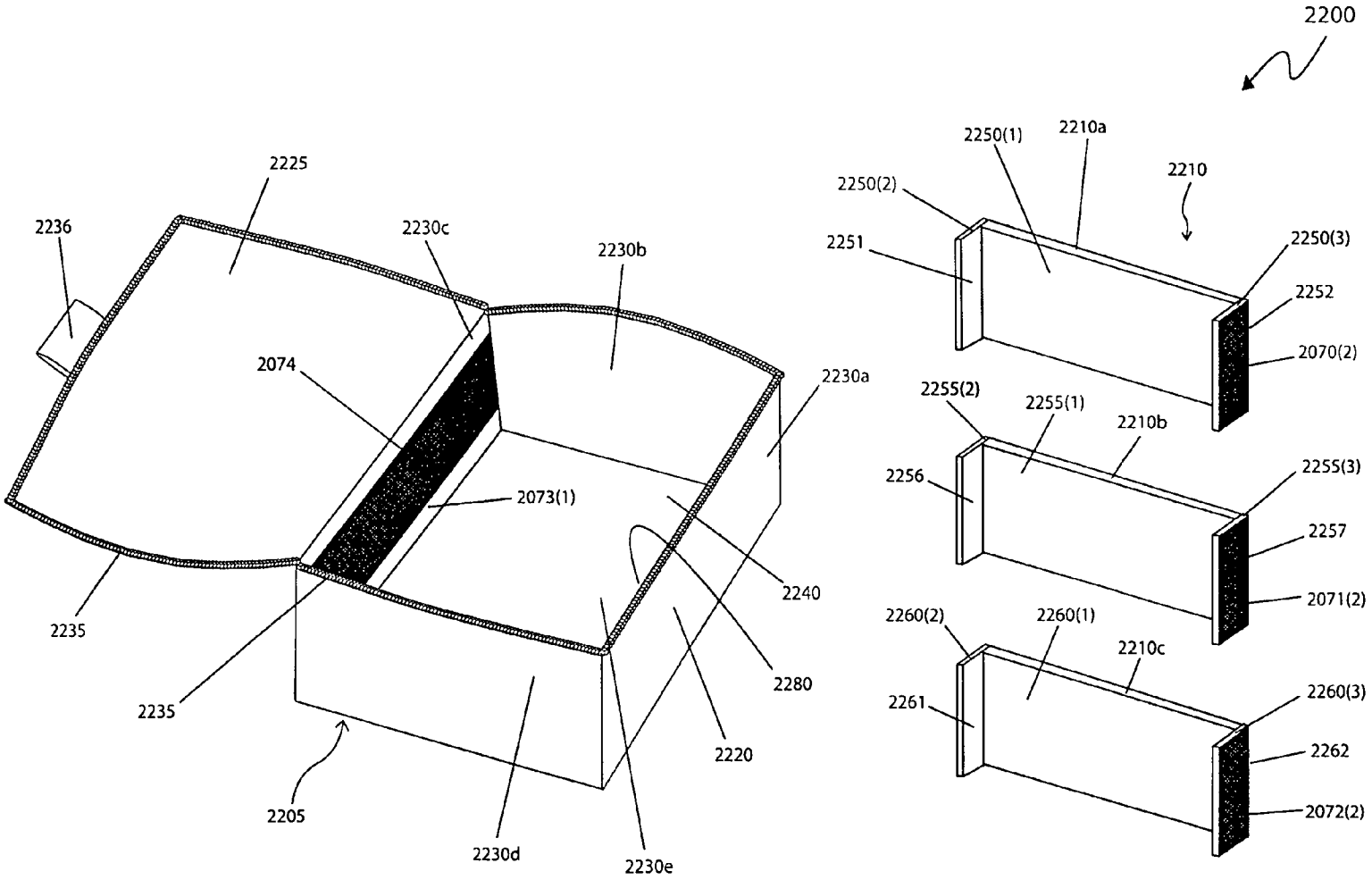
FIG. 20 is a perspective view of a luggage organizer in accordance with an embodiment of the invention.

FIG. 20 is a perspective view of a luggage organizer 2200 in accordance with an embodiment of the invention. The luggage organizer 2200 comprises an organizer body 2205 and dividers 2210. For example, the dividers 2210 includes the dividers 2210*a*, 2210*b*, and 2210*c*. However, the number of dividers 2210 may vary.

In an embodiment, the body 2205 includes a holder portion 2220 and a movable cover portion 2225 that removably covers the holder portion 2220. The holder portion 2220 includes the four vertical walls 2230*a*, 2230*b*, 2230*c*, and 2230*d*, and a bottom wall 2230*e*. The movable cover portion 2225 are movably coupled to the rear wall 2230*c*. The walls 2230*a*-2230*c* are coupled to and positioned vertically along the respective edges of the bottom wall 2230*e*.

The organizer body 2205 can be made of any suitable material such as, for example, nylon, cloth, wood, plastic, rigid resin, synthetic material, or other materials that can hold items such as clothes and/or shoes and/or other items.

The movable cover portion 2225 can removably cover the inner hollow portion 2240 that is defined and surrounded by the walls 2230*a* through 2230*e*. The movable portion 2225 can be removably attached to the walls 2230*a* through 2230*d* by a locking mechanism 2235 such as, for example, a zipper 2235 or other suitable locking mechanisms such as, for example, buttons, Velcro, or other locking mechanisms that can removably secure the cover portion 2225 to the walls 2230*a*-2230*d*. An attachment mechanism 2236 may also be included to removably couple the cover 2225 to the body 2220.

In an embodiment of the invention, each divider 2210 includes a vertical body and sides. For example, the divider 2210*a* includes the vertical body 2250(1) and sides 2250(2) and 2250(3) which are attached in a perpendicular direction on the vertical body 2250(1). The side 2250(2) is disposed on a first end 2251 of the body 2250(1) and the side 2205(3) is disposed on a second end 2252 of the body 2250(1).

As another example, the divider 2210*b* includes the vertical body 2255(1) and sides 2255(2) and 2255(3) which are attached in a perpendicular direction on the vertical body 2255(1). The side 2255(2) is disposed on a first end 2256 of the body 2255(1) and the side 2255(3) is disposed on a second end 2257 of the body 2255(1).

As another example, the divider 2210*c* includes the vertical body 2260(1) and sides 2260(2) and 2260(3) which are attached in a perpendicular direction on the vertical body 2260(1). The side 2260(2) is disposed on a first end 2261 of the body 2260(1) and the side 2260(3) is disposed on a second end 2262 of the body 2260(1).

The plurality of dividers 2210 can be made of any suitable material such as, for example, nylon, cloth, wood, plastic, rigid resin, synthetic material, or other materials. Each of the dividers 2210*a*, 2210*b*, and 2210*c* can be the same material or each of the dividers 2210*a*, 2210*b*, and 2210*c* can be different materials, or at least two of the dividers 2210*a*, 2210*b*, and 2210 can be the same material.

Each of the sides 2252(2) and 2252(3) includes the attachment components 2070(1) (shown in FIG. 23) and 2070(2), respectively. Similarly, each of the sides 2255(2) and 2255(3) includes the attachment components 2071(1) (shown in FIG. 23) and 2071(2), respectively. Similarly, each of the sides 2260(2) and 2260(3) includes the attachment components 2072(1) (shown in FIG. 23) and 2072(2), respectively.

The attachment components 2070(1), 2071(1), and 2072(1) are removably attached (or are removably attachable) to the attachment component 2073(1) in the inner surface 2074 of the wall 2230*c*. The attachment components 2070(1), 2071(1), and 2072(1) and 2073(1) are, for example, hook and loop components, buttons or a ball-pin lock that can be removably attached to each other, or other suitable snap-on or snap-together locking mechanisms for removably coupling two components together, so that the dividers 2210 are removably coupled to the wall 2230*c* via the attachment components 2070(1), 2071(1), and 2072(1) and 2073(1).

The attachment components 2070(2), 2071(2), and 2072(2) are removably attached (or are removably attachable) to an attachment component in the inner surface 2080 of the wall 2230*a*. The attachment components 2070(2), 2071(2), and 2072(2) and the attachment component on the inner surface 2080 are, for example, hook and loop components, buttons or a ball-pin lock that can be removably attached to each other, or other suitable snap-on or snap-together locking mechanisms for removably coupling two components together, so that the dividers 2210 are removably coupled to the wall 2230*a* via the attachment components 2070(2), 2071(2), and 2072(2) and the attachment component 2073(1) on the inner surface 2080.

Figure 21:
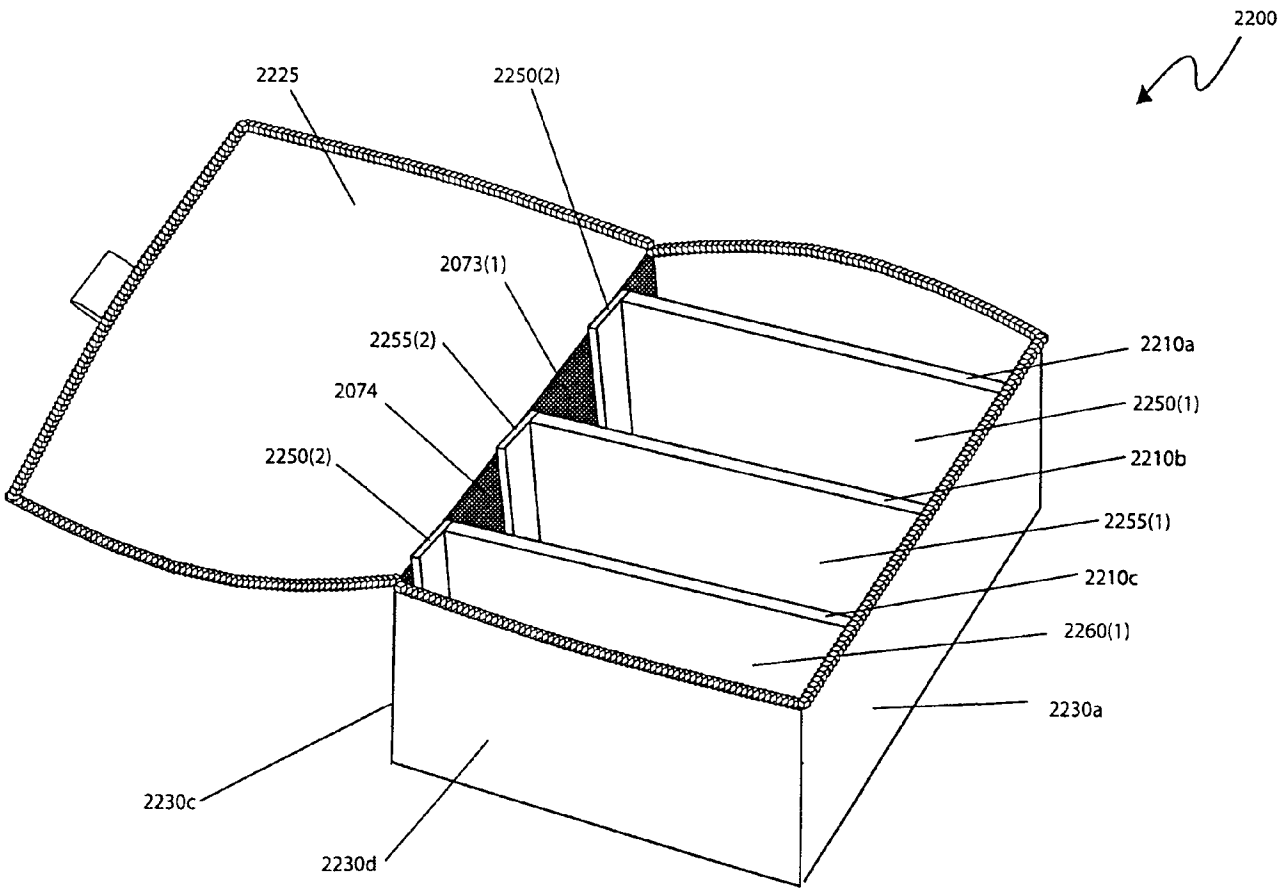
FIG. 21 is another perspective view of a luggage organizer in accordance with an embodiment of the invention.

FIG. 21 is another perspective view of a luggage organizer 2200 in accordance with an embodiment of the invention. The dividers 2210*a*, 2210*b*, and 2210*c* are removably coupled to the wall 2230*c* via the attachment components 2070(1), 2071(1), and 2072(1) and the attachment component 2073(1) on the inner surface 2074 of the wall 2030*c*.

Figure 22:
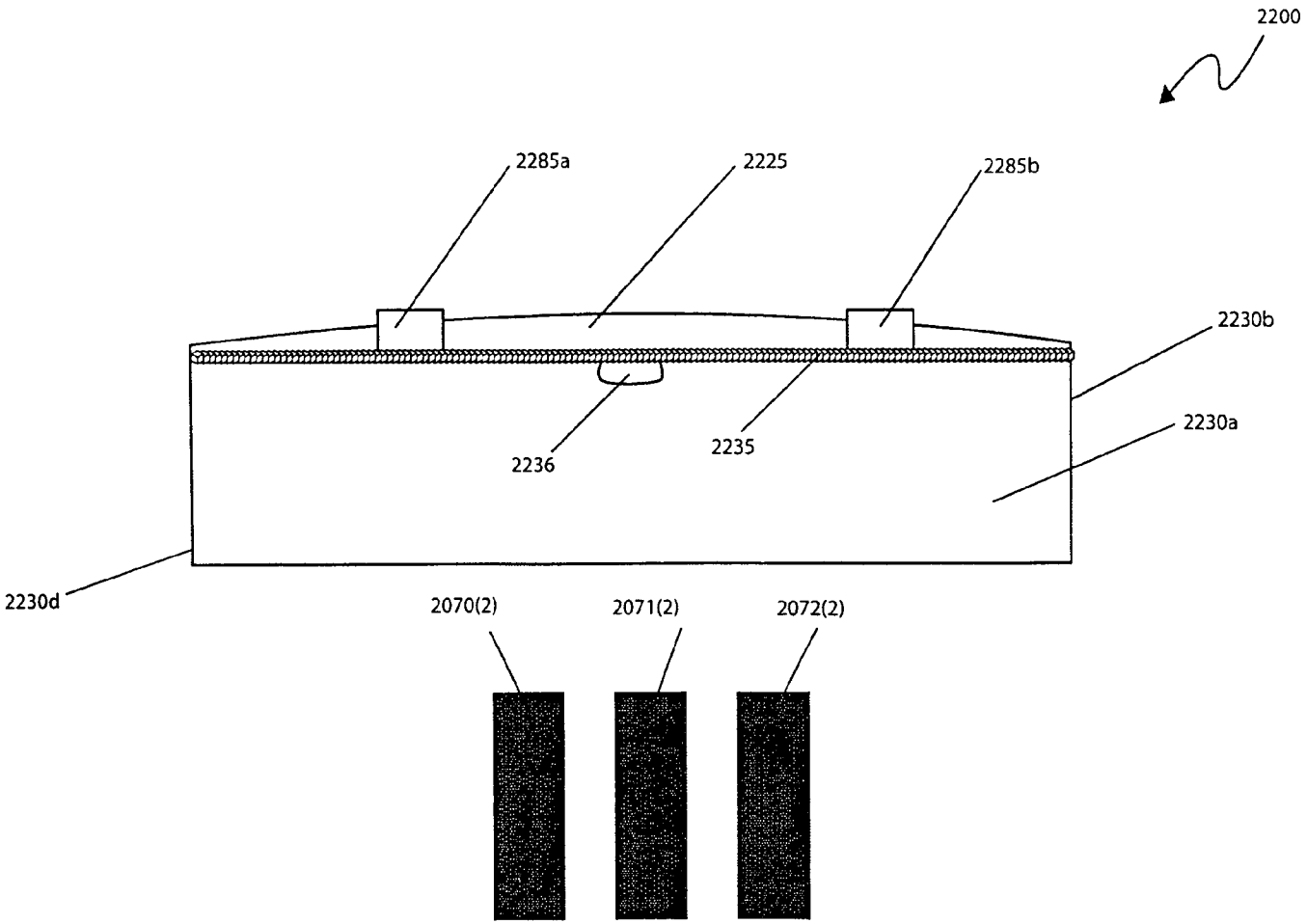
FIG. 22 is a front elevational view of a luggage organizer in accordance with an embodiment of the invention.

FIG. 22 is a front elevational view of a luggage organizer 220 in accordance with an embodiment of the invention. The cover 2225 is shown as removably attached to the walls 2230*a*, 2230*b*, and 2230*c*. The components 2285*a* and 2285*b* can make the cover 2225 to be more rigid and permits the cover 2225 to pivot on an edge 2286 (FIG. 23) of the wall 2230*c*.

Figure 23:
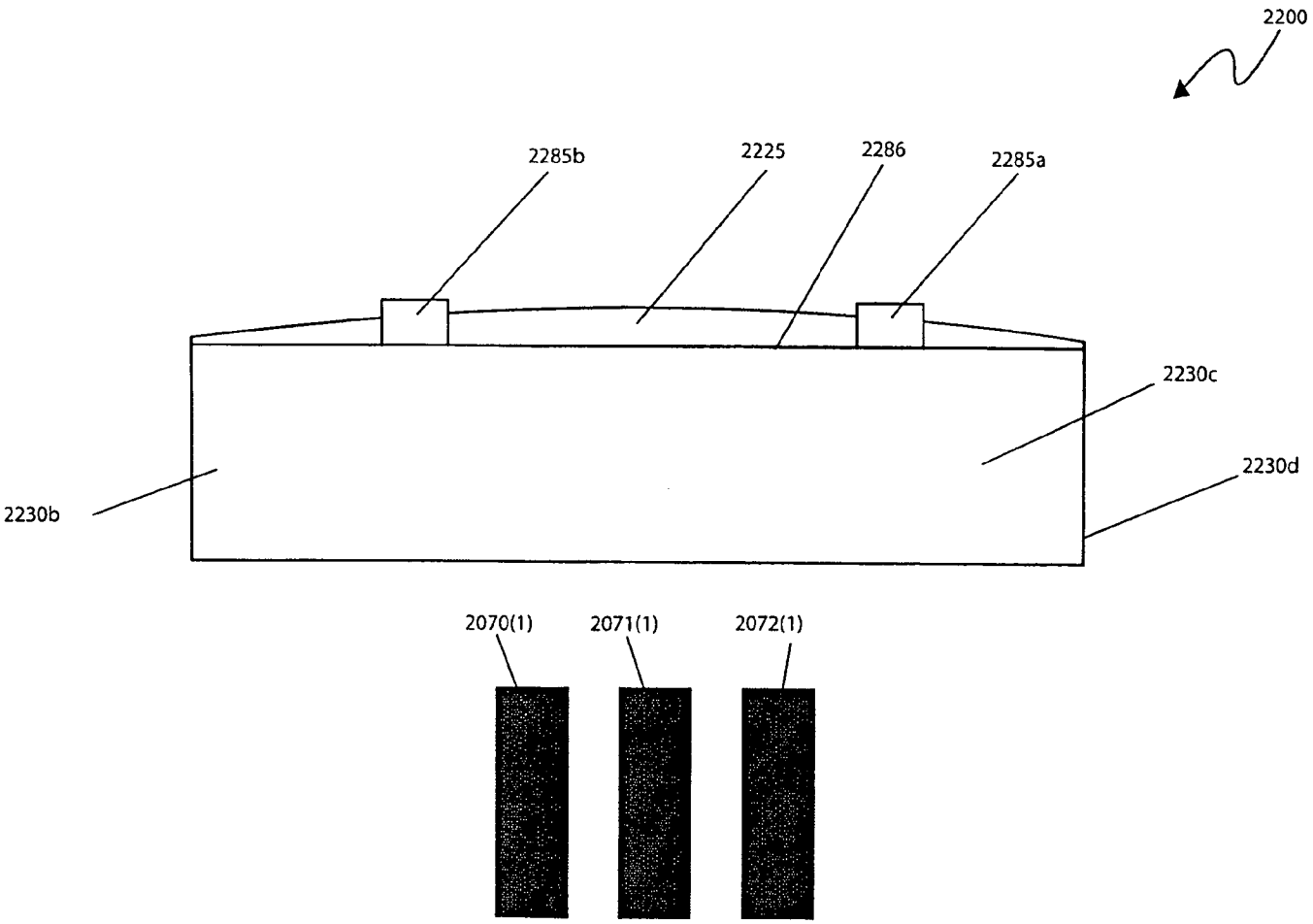
FIG. 23 is a rear elevational view of a luggage organizer in accordance with an embodiment of the invention.

FIG. 23 is a rear elevational view of a luggage organizer 2200 in accordance with an embodiment of the invention.

Figure 24:
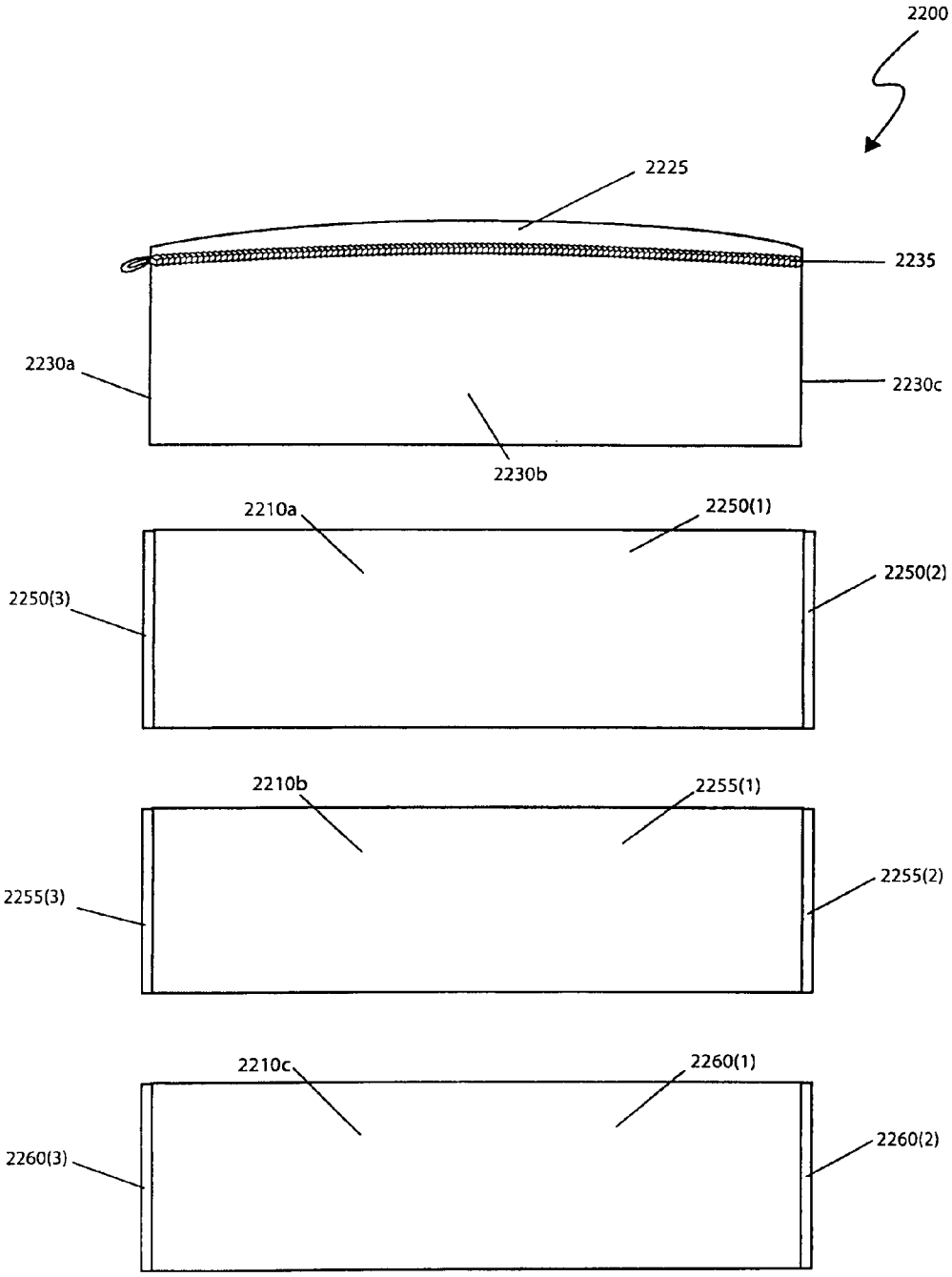
FIG. 24 is a left side elevational view of a luggage organizer in accordance with an embodiment of the invention.

FIG. 24 is a left side elevational view of a luggage organizer 2200 in accordance with an embodiment of the invention.

Figure 25:
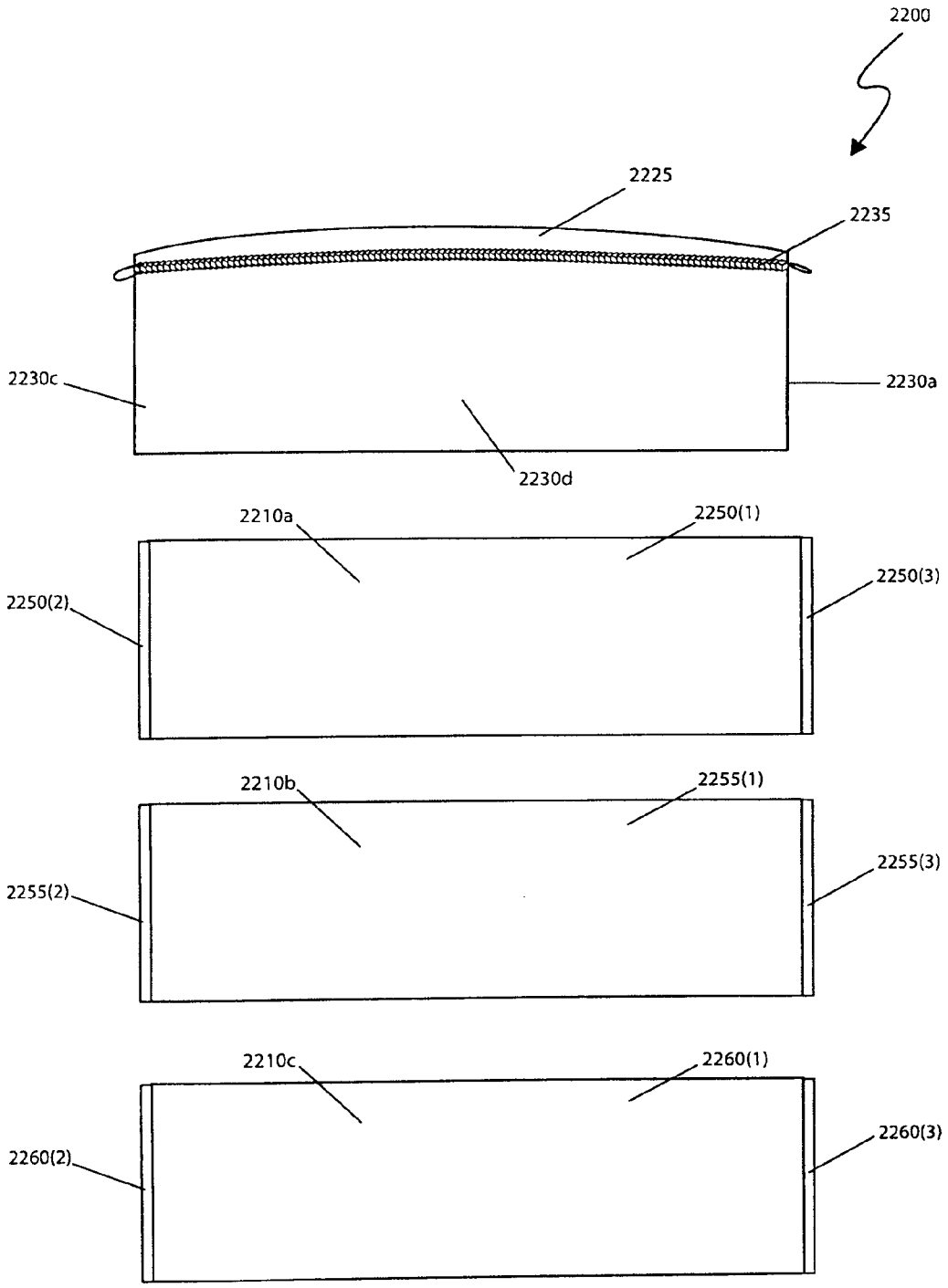
FIG. 25 is a right side elevational view of a luggage organizer in accordance with an embodiment of the invention.

FIG. 25 is a right side elevational view of a luggage organizer 2200 in accordance with an embodiment of the invention.

Figure 26:
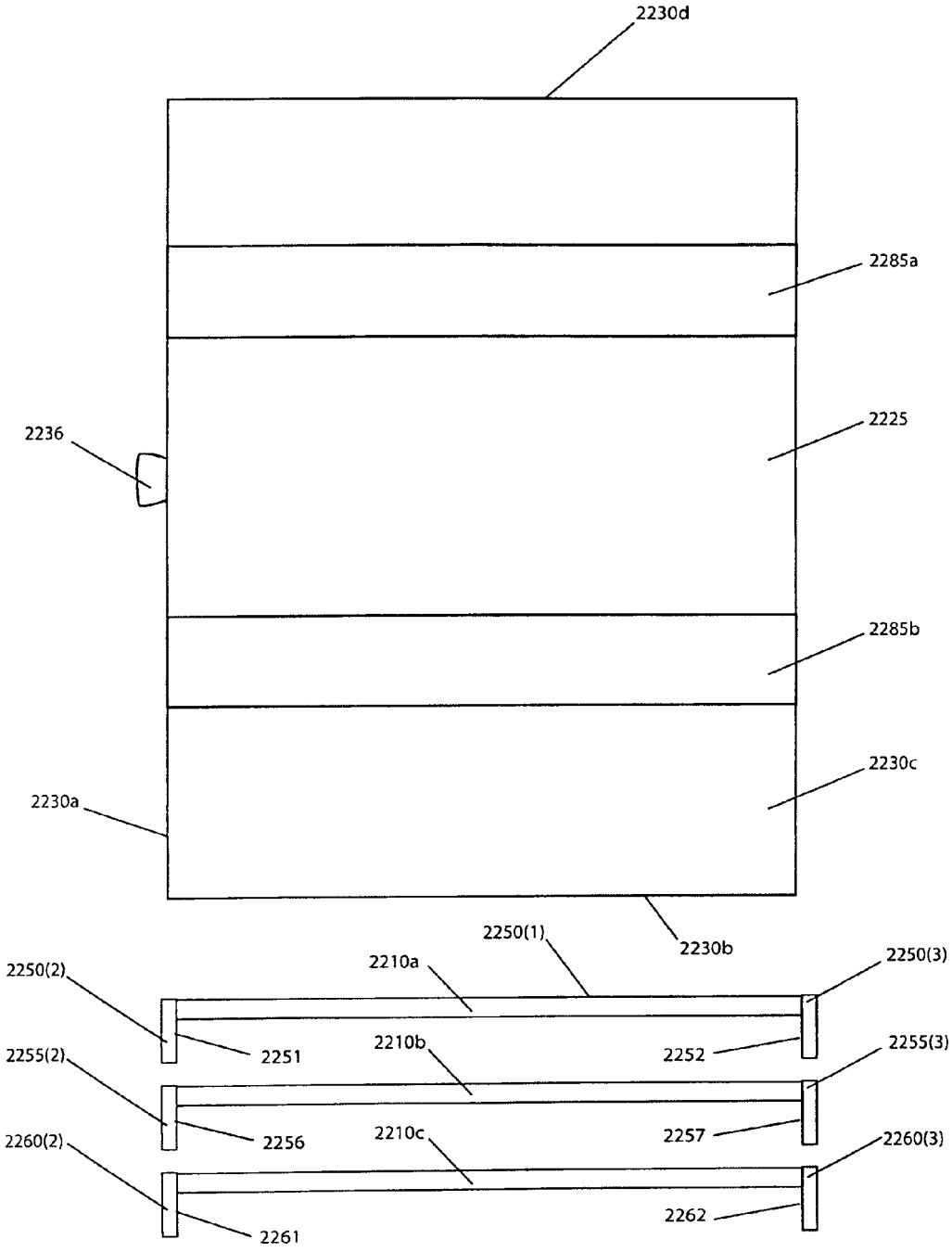
FIG. 26 is a top plan view of a luggage organizer in accordance with an embodiment of the invention.

FIG. 26 is a top plan view of a luggage organizer 2200 in accordance with an embodiment of the invention.

Figure 27:
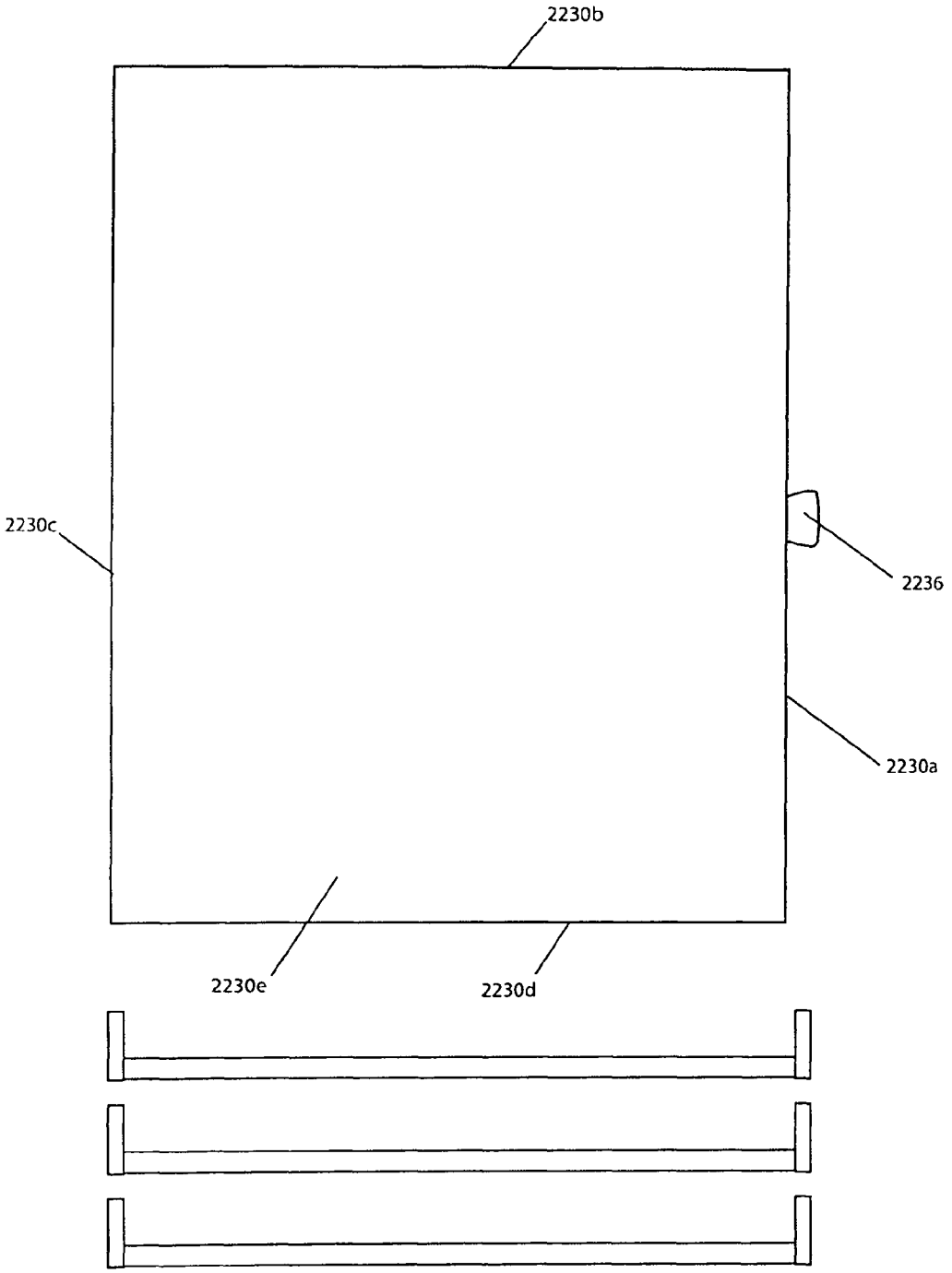
FIG. 27 is a bottom plan view of a luggage organizer in accordance with an embodiment of the invention.

FIG. 27 is a bottom plan view of a luggage organizer 2220 in accordance with an embodiment of the invention.

Figure 28:
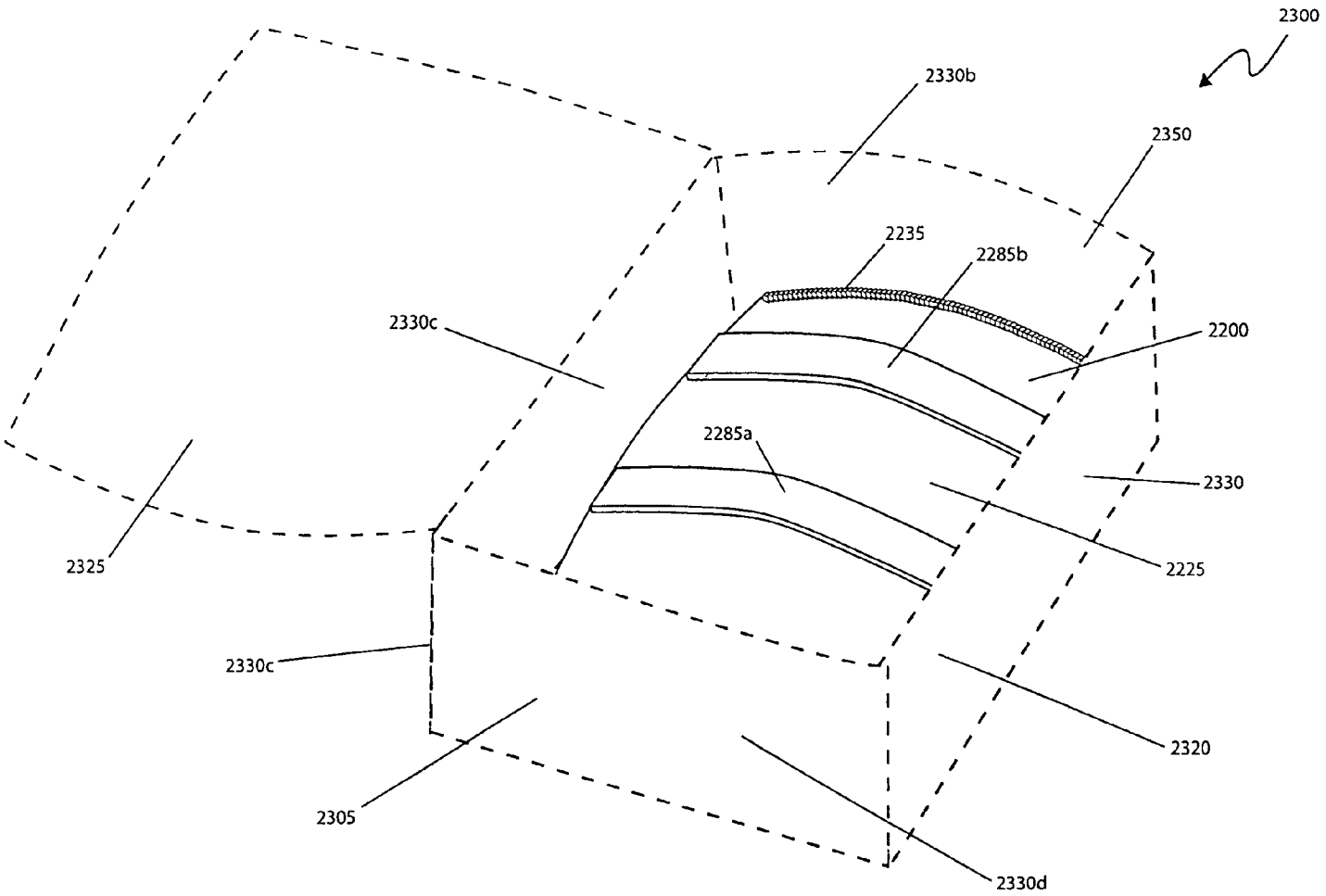
FIG. 28 is a perspective view of a luggage organizer in accordance with an embodiment of the invention, wherein the luggage organizer is disposed within a luggage.

FIG. 28 is a perspective view of a luggage organizer 2220 in accordance with an embodiment of the invention, wherein the luggage organizer 2220 is disposed within a luggage 2300. The luggage 2300 can be made of any suitable material.

The luggage 2300 includes a body 2305 includes a holder portion 2320 and a movable cover portion 2325 that removably covers the holder portion 2320. The holder portion 2220 includes the four vertical walls 2330*a*, 2330*b*, 2330*c*, and 2330*d*, and a bottom wall. The movable cover portion 2325 are movably coupled to the rear wall 2330*c*. The walls 2330*a*-2330*c* are coupled to and positioned vertically along the respective edges of the bottom wall of the body 2305. The luggage organizer 2200 is disposed within the inner opening 2350 of body 2305.

Other variations and modifications of the above-described embodiments and methods are possible in light of the teaching discussed herein.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An apparatus comprising:

a portable item storage device comprising a luggage having an inner opening and a luggage wall;

a rack disposed on the luggage wall of the luggage and disposed within the inner opening and within the luggage;

a first shoe spacer and a second shoe spacer, each shoe spacer removably coupled to the rack and adjustable in size;

wherein the rack comprises a horizontal member, a first vertical member coupled to the horizontal member, a second vertical member coupled to the horizontal member;

a first attachment mechanism and a first bracket that is removably coupled by the first attachment mechanism to the first shoe spacer, wherein the first bracket is coupled to the horizontal member;

a second attachment mechanism and a second bracket that is removably coupled by the second attachment mechanism to the second shoe spacer, wherein the second bracket is coupled to the horizontal member;

wherein the first shoe spacer is inserted into a first shoe piece and is removably securable to the first shoe piece;

wherein the second shoe spacer is inserted into a second shoe piece and is removably securable to the second shoe piece;

wherein the rack, first bracket, first attachment mechanism, and first shoe spacer are configured to hold and to secure the first shoe piece in a static position and non-moving position so that the first shoe piece is secured to the rack in the static position;

wherein the rack, second bracket, second attachment mechanism, and second shoe spacer are configured to hold and to secure the second shoe piece in a static position and non-moving position so that the second shoe piece is secured to the rack in the static position;

a first base member and a second base member, wherein the first and second base members are permanently coupled to the luggage wall;

a first sliding member that can slide along the first base member, wherein the first vertical member is on the first sliding member;

a second sliding member that can slide along the second base member, wherein the second vertical member is on the second sliding member;

wherein the first and second sliding members are configured to slide in an outward direction in order to slide out the rack from the luggage;

wherein the first and second sliding members are configured to slide in an inward direction in order to slide in the rack into the luggage;

wherein the first attachment mechanism comprises a first attachment component and a second attachment component;

wherein the second attachment mechanism comprises a third attachment component and a fourth attachment component;

wherein the first shoe spacer is detached from the first bracket by detaching the second attachment component from the first attachment component in a first direction;

wherein the second shoe spacer is detached from the second bracket by detaching the fourth attachment component from the third attachment component in the first direction;

wherein the first shoe spacer is attached to the first bracket by attaching the second attachment component to the first attachment component in a second direction;

wherein the second shoe spacer is attached to the second bracket by attaching the fourth attachment component to the third attachment component in the second direction;

wherein the first shoe spacer comprises a first adjustable member that is directly coupled to the second attachment component and wherein the second shoe spacer comprises a second adjustable member that is directly coupled to the fourth attachment component;

wherein the first adjustable member adjusts the first shoe spacer in size and configuration so that the first shoe spacer is adjustable to fit into shoes of different sizes; and wherein the second adjustable member adjusts the second shoe spacer in size and configuration so that the second shoe spacer is adjustable to fit into shoes of different sizes.

2. The apparatus of claim 1, wherein the rack is slidable at various positions with respect to the portable item storage device.

3. The apparatus of claim 1, further comprising:

a third shoe spacer;

a fourth shoe spacer;

a third attachment mechanism and a third bracket that is removably coupled by the third attachment mechanism to the third shoe spacer, wherein the third bracket is coupled to the horizontal member;

a fourth attachment mechanism and a fourth bracket that is removably coupled by the fourth attachment mechanism to the fourth shoe spacer, wherein the fourth bracket is coupled to the horizontal member.

4. The apparatus of claim 1, wherein the first shoe spacer comprises a first front member and a first rear member coupled to the first front member and to the first adjustable member;

wherein the first adjustable member comprises a first left portion having a first plurality of apertures and a first right portion having a second plurality of apertures;

wherein the first rear member is removably attached to a first aperture in the first plurality of apertures and wherein a first end portion of the first right portion is removably attached to a second aperture in the second plurality of apertures and is also removably attached to a third aperture in the first plurality of apertures so that a size of the first shoe spacer is adjustable to fit different shoe sizes and is adjustable to removably secure different shoe sizes in the static position; and wherein the second shoe spacer comprises a second front member and a second rear member coupled to the second front member and to the second adjustable member;

wherein the second adjustable member comprises a second left portion having a third plurality of apertures and a second right portion having a fourth plurality of apertures;

wherein the second rear member is removably attached to a fourth aperture in the third plurality of apertures and wherein a second end portion of the second right portion is removably attached to a fifth aperture in the fourth plurality of apertures and is also removably attached to a sixth aperture in the third plurality of apertures so that a size of the second shoe spacer is adjustable to fit different shoe sizes and is adjustable to removably secure different shoe sizes in the static position.

5. The apparatus of claim 1, wherein the first attachment mechanism comprises a first ball-pin lock and wherein the second attachment mechanism comprises a second ball-pin lock.

6. The apparatus of claim 1, wherein the first attachment mechanism comprises a first snap-on locking mechanism and wherein the second attachment mechanism comprises a second snap-on locking mechanism.

7. The apparatus of claim 1, wherein the rack comprises a second horizontal member coupled to the vertical members, and wherein additional brackets are coupled to the second horizontal member and wherein additional shoe spacers are respectively removably coupled to the additional brackets, and wherein the horizontal members are offset vertically by a distance L1.

8. The apparatus of claim 1 wherein the shoe spacer comprises parts comprising flexible and sufficiently firm material so that the shoe spacer is adjustable in size and can be removably inserted into and removably secured with different shoe sizes.

* * * * *